US005860257A

United States Patent [19]

Gerhaher et al.

[11] Patent Number: 5,860,257

[45] Date of Patent: Jan. 19, 1999

[54] BRACKET MOUNTED FACADE STRUCTURE

[76] Inventors: Max Gerhaher, Dr.-Aicher-Str. 3, 94405, Landau/Isar; Franz Gerhaher, Stadtgraben 20, 94315, Straubing, both of Germany

[21] Appl. No.: 490,618

[22] Filed: Jun. 15, 1995

[30] Foreign Application Priority Data

Jun. 15, 1994 [DE] Germany ..... 44 20 890.1

[51] Int. Cl.[6] ..... E04F 13/08

[52] U.S. Cl. ..... 52/235; 52/482; 52/506.05; 52/506.08; 52/506.06; 52/597; 52/772; 52/302.3

[58] Field of Search ..... 52/235, 384, 385, 52/387, 475.1, 482, 506.05, 506.06, 506.08, 506.09, 508, 510, 513, 582.1, 597, 715, 302.1, 302.3, 302.4, 772, 774

[56] References Cited

U.S. PATENT DOCUMENTS

| | | | |
|---|---|---|---|
| 1,589,560 | 6/1926 | Reuter | 52/209 |
| 2,054,511 | 9/1936 | Hornicek | 52/385 X |
| 2,097,069 | 10/1937 | Klages | 52/506.06 |
| 2,132,547 | 10/1938 | Sohn | 52/506.08 |
| 2,791,011 | 5/1957 | Heep | 52/209 |
| 2,976,970 | 3/1961 | Toney | 52/209 X |
| 3,319,388 | 5/1967 | Olsen | 52/209 X |
| 3,383,815 | 5/1968 | Smith, Jr. | 52/209 |
| 3,888,055 | 6/1975 | Gallo | 52/235 X |
| 4,107,887 | 8/1978 | Wendt | 52/235 X |
| 4,516,373 | 5/1985 | Osawa | 52/387 |
| 4,741,141 | 5/1988 | Harke | 52/506.06 |
| 5,155,958 | 10/1992 | Huff | 52/235 |
| 5,245,808 | 9/1993 | Grunewald | 52/235 |
| 5,313,760 | 5/1994 | Tojo | 52/513 X |
| 5,544,461 | 8/1996 | Sommerstein | 52/510 X |

FOREIGN PATENT DOCUMENTS

| | | | |
|---|---|---|---|
| 100431 | 2/1984 | European Pat. Off. | 52/235 |
| 1284650 | 1/1962 | France | 52/513 |
| 2348072 | 4/1975 | Germany | 52/235 |
| 3636565 | 8/1988 | Germany | 52/384 |
| 3934686 | 6/1990 | Germany | 52/384 |
| 34 01 271 | 5/1991 | Germany . | |
| 36 27 583 | 6/1991 | Germany . | |
| 36 27 584 | 6/1991 | Germany . | |
| 4242535 | 6/1994 | Germany | 52/384 |
| 4-366270 | 12/1992 | Japan | 52/506.06 |
| 5-33449 | 2/1993 | Japan | 52/506.06 |
| 104144 | 4/1964 | Norway | 52/235 |
| 558863 | 2/1975 | Switzerland | 52/506.08 |
| 1596030 | 9/1990 | Switzerland | 52/235 |
| 200561 | 7/1923 | United Kingdom | 52/506.06 |
| WO 88/03204 | 5/1988 | WIPO | 52/235 |

OTHER PUBLICATIONS

Fassaden Eternit–Canaleta®, 1981.

*Primary Examiner*—Carl D. Friedman
*Assistant Examiner*—Laura A. Callo
*Attorney, Agent, or Firm*—Morgan & Finnegan, LLP

[57] ABSTRACT

A bracket mounted facade structure comprises a girder part, preferably horizontal girder parts (1), which with one girder part, preferably an H section girder part (2) and/or with a U section girder part fit around parts of the facade tiles (3 and 4), more particularly tile flanges (5 and 6) with play. In order to improve such structure technically and economically, the vertical play (7) between the preferably ceramic facade tiles (3) or tile flanges (5) and the center web (8) of the girder part or, respectively, of the U section girder part or, respectively, of the H section girder part (2) is completely or partially filled by components, preferably pins (9). Such pins (9) are secured in position by facade tiles (10) placed thereover or by the flanges (5) thereof to prevent them from falling or being pulled out.

4 Claims, 27 Drawing Sheets section A-A section B-B section D-D

BRACKET MOUNTED FACADE STRUCTURE

The invention relates to a bracket mounted facade structure preferably carried on an aluminum structure. The invention also relates to a girder element, more particularly in the form of a U-shaped extruded element or more especially an H section one.

The German patent publication 3,401,271 A and the German patent publication 3,627,583 A disclose facade structures, which comprise extruded ceramic facade tiles, short extruded aluminum tile brackets, aluminum bearer girders, main girders and anchoring means. In the case of these structures the top and bottom flanges of the facade tiles are encompassed by the H section parts of the tile brackets practically only at given points and set at a certain distance from the front edge of the support girders on the same, such distance serving for ventilation and capillary separation.

The disadvantages of such structure reside in the amount of assembly work and material required when screwing or clipping on two tiles brackets for two respective tiles brackets on the support girders. Furthermore the facade tiles and more particularly the flanges, at which they are gripped by the tiles brackets, are substantially liable to damage by jerks, since the transfer of the force or load takes place at a point. A further disadvantage is that owing to the large dimensional inaccuracies to which ceramic facade tiles are prone, pre-assembly of the support girders must be performed with corresponding oversize allowances such that in the case of assembly of undersize facade tiles the bottom flange of such facade tiles may still be lifted out of the tile brackets. Furthermore the later replacement of any damaged facade tiles is difficult. The disadvantage resides in the fact that the height of the top flange of the top tiles being replaced must be reduced so that the bottom flange of such tile can be inserted into its lower bracket. In order to render impossible later lifting of such facade tile out of its position the play above the foreshortened top flange must be taken up by filling the tile bracket, for instance with a curing silicone rubber; this is however awkward to apply and may also lead to fouling of the facade tiles. A further disadvantage of the known structure is that owing to the unavoidable inaccuracies in ceramic material, sufficient play must be allowed between the flanges, fitting about the tile flanges, of the tile brackets and the top and bottom flanges of the facade tile. In order to prevent possible rattling of the facade tiles in the wind resilient rails are required behind the facade tile to take up play as disclosed in the German patent publication 3,627,584 A, same increasing assembly and fitting costs. A further disadvantage is that the overall depth of the supporting girders must be kept relatively small in order to keep the overall depth of the facade structure generally as low as possible. Accordingly the moment of resistance of the supporting girder about the Y axis is relatively small, which is relevant for withstanding wind forces (edge suction). The calculated wind forces in the marginal portion of high buildings are in fact far greater than the forces on such bracket mounted facades owing to their own weight. Furthermore the moment of resistance against torsion of the open girder cross sections is low so that high tension forces due to wind and the weight of the facade are likely. A further disadvantage of such attachment of the facade tiles by their own individual tile brackets resides in the fact that such brackets are less suitable for the attachment of facade tiles with vertically arranged holes, since bracket spacings exactly matching the hole distances are required. Even more difficulties and costs are involved by the attachment of acoustically insulating facade tiles with holes perpendicular to the front surface, since during production thereof by extrusion attachment flanges may only be pressed parallel to the direction of the holes. Furthermore the design of many details of connections, for example between the corners of a building and window jambs and more particularly window lintels and sills and facade tiles is bound to involve difficulties and high costs. A still further unsolved problem, which sometimes occurs, is furthermore that shade elements integrated in the facade are to be manufactured of the same cladding material and secured to the building so as to be movable or adjustable rather than being fixed to the building rigidly.

Furthermore so-called boxed facades are employed in building practice, in the case of which supporting girders and facade tiles are pre-mounted in a box frame and then moved into place on the building using a crane as large-area facade elements. The disadvantage of such box designs is as a rule that in the case of large box widths that firstly the transfer of wind forces and forces due to the weight of the facade tiles must be by the horizontal support girder, owing to the large spans, to one or more vertical main girders, and from the same to the top and bottom box frame girders, which are then subjected to a very high bending load. The load is then transferred to the two vertical box frame girders, which are anchored to the wall of the building. Owing to tortuous path of force transfer and the high load on the frame girders, more especially with a bending effect, the boxes must be very strong and heavy in design and will be correspondingly expensive. A further problem which has not so far been tackled relates to thermal expansion of the preferably horizontal support girders, since the main girders at the edge are relatively far removed from one another and aluminum, as the preferred material for facade structure, possesses a very high coefficient of thermal expansion. Much the same applies for thermal expansion of the preferably vertical main girders. For particularly large spans involving external supports, such as for example in acoustic damping screens on freeways and other roads, such structures are unsuitable, since using the support girders alone no sufficient flexural strength can be achieved as is necessary to resist winds and to stand up to the inherent weight of the arrangement. Moreover the backing structure is always fully visible from the rear, something which is undesired, for example in the case of acoustic damping screens and furthermore in the case of certain buildings as well.

One object of the bracket mounted facade structure in accordance with the invention is accordingly a technical and economic improvement thereof.

The object of the invention is to be achieved using the features described herein. The advantage of this design resides in that assembly of the support girders may be performed with so much vertical play that the facade tiles may be slid into place with the top flange first from below into the top support girder and moved up so far that even facade tiles with oversize may be lifted into place and lowered with their bottom flange still in the bottom support girder. The necessary play of the fitted facade tiles or, respectively, over their top flange should be at least equal to the sum of the height of the front top flange of the support girder, the permissible tolerated oversize of the facade tile's height and the permissible tolerated undersize of the support girder spacing. Accordingly it is possible to ensure that even the bottom end or, respectively, bottom flange of the largest permitted facade tile can be lifted into place in the support girder in the case of the minimum permissible distance between support girders. The front and the rear bottom flanges must be, in this case, so long that they fit about the top edge, respectively, top flange of the smallest permissible facade tile (largest undersize in the tile height) in the case of the simultaneously largest permissible tolerated distance between support girders (largest oversize) still with a certainly large overlap in order to certainly prevent any tipping out of position of the facade tiles.

The residual play, whose size differs in a manner dependent on the combination of the individual manufacturing inaccuracies above the top edge of the tile or over the top flange thereof, is allowed for by pins or bolts of different length, which—after installation of the facade tile are inserted from above in the support girder or which—are inserted at different levels from the front into the bottom half of the H section part of the support girder. Mounting the next facade tile arranged thereover means that such pins are held against falling out or being pulled out. In the one case the top facade tile will have its bottom edge or, respectively, its bottom flange on the vertical pin whereas in the other case the drip flange or the bottom edge of the top facade tile will be arranged in front of the top of the horizontal pin. The arrangement with the vertical pins offers the advantage of being able to lift the top tile, using a greater force, over the pin and hence the bottom tile is also able to be lifted and drawn clear in an upward direction.

In the case of the arrangement with the horizontal pins it is impossible for the facade tile now to be lifted, if the pin or pins are inserted in the lowest holes which are available. The particular advantage of the two embodiments of the invention lies in the fact that after fitting of the support girders the facade tiles may be installed but however owing to the compensation of the vertical play between on the one hand the top of the tile and, respectively, the top flange and on the other hand the support girder they can not be removed again. In the case of the known structure as disclosed in the above mentioned patent publications such securing in position is performed by the fitting of additional tile brackets after installation of the facade tiles arranged underneath same, something which is no longer necessary owing to the insertion of the vertical or horizontal pins. This means that there is a substantial saving in material and labor.

In the case of a preferred embodiment of the invention the horizontal play between the top of the facade tile or top tile flange and the support girder is completely or partially taken up by a bolt or pin fitting form above into the play clearance. This offers the advantage that rattling of the facade tiles in the wind is prevented and that between the top flange and the extruded support girder a vertical venting gap will be left.

In the case of another embodiment of the invention the vertical or horizontal play between the top or top flange of the facade tile and the support girder fitted about it is filled with a curing composition, such as silicone rubber and consequently taken up, such composition being introduced for instance through openings in the front bottom flange or in the middle web after fitting of the facade tile in place.

A further improvement involves the provision of ventilation holes or slots in one or both bottom flanges. This provides the advantage that the necessary ventilation between the front and rear sides of the facade tiles is possible even if the facade tiles make sealing contact on one or both flanges of the support girder along the full length thereof.

In another embodiment the H section part of the support girder is connected via a web with a rear (on the wall side) and preferably vertical flange. The advantage of this is that the front and rear flanges of the H section girder part on the one hand via the web with the rear flange constitute a horizontal double T girder, which is particularly suitable for taking up strong wind forces owing to its high moment of resistance about the vertical Y axis. This can be additionally increased by additional reinforcement of the front flange and of the rear flange. Owing to such arrangement substantial savings may be made in the overall depth of the facade tile. Furthermore a substantial advantage is to be obtained thereby to the extent that for the design of all parts of the building constituting external corners, that is to say external corners of the building and furthermore window and door jambs particularly simple and accurate designs become possible. In the case of such details it is only necessary to make a saw cut in a horizontal direction from the front side of the facade as far as the front side of the flange on the wall side so that the angle may be easily set very exactly without additional design work being necessary.

In the case of another design of the facade structure of the invention the web is preferably provided with openings in a manner rising obliquely to the rear between the H section support girder and the rear flange (on the wall side). The advantage of this form resides in the fact that on the one hand rear ventilation is possible for the entire facade structure between the facade tiles and on the other hand the thermal insulation arranged behind the wall side flange. Moreover the rearwardly rising and forwardly descending web means that water forced inward by the wind or condensed water will be diverted off forward toward the H section girder part, where it may flow away through the openings in the web and is then let off adjacent to rear side of the facade tiles as far as the bottom point of the structure. Owing to this way of conducting the water or, respectively, capillary separation, the vertical backing structure, on which the preferably horizontal support girders are arranged, and the thermal insulation will be kept dry.

In the case of another embodiment of the facade structure the horizontal web of the H section support girder part is provided with numerous lugs stamped out on two or more sides connected with the web, which during assembly after installation of the facade tiles arranged underneath the support girder are bent downward, preferably till they come into contact with the facade tile or the top flange thereof. In the design in accordance with the invention such lugs perform the function of the vertical compensation for play between the top edge of the facade tile or, respectively, its top flange on the one hand and the horizontal web of the H section parts of the support girder on the other hand, takes place using the pins inserted here and using a filling composition. It is an advantage if the lugs are bent so far that the top part thereof is directed very steeply downward, whereas the bottom part extends at a smaller angle, because, owing to this, the leverage for bending back the lug is shorter and the holding force is greater. The particular advantages of this design reside in that the additional labor and material required for the insertion of the pins or the introduction of the filling composition is no longer necessary, although however the facade tiles are from the very beginning substantially free of play and attached with a high degree of security to the backing structure.

A further possible design is that lugs of alternating length are provided. The advantage of the longer lugs is that owing to the longer leverage they can be bent downward with less effort. The advantage of the shorter lugs is on the contrary that they may be bent downward at a greater angle so that the securing forces become greater, since the lever arm for bending back is smaller. The advantage of the lugs, which are bent in opposite directions is that on making resilient contact with the facade tile displacement of the same in the either horizontal direction is prevented owing to the self-locking action.

In accordance with the invention contemplates a design in which the lug end is made oblique or pointed on one side or the entire lug is arranged obliquely. The advantage resulting from this is that the top facade tile edge or the top flange of the facade tile is contacted on one side and accordingly thrust away on one side. Accordingly the horizontal play of the top of the facade tile or, respectively, of the top flange in the H section part of the support girder as well is compensated for and rattling of the facade tile is prevented. Furthermore an arrangement of the lugs in the vicinity of the front flange of the support girders is conducive of an effective capillary transfer of the water running down the back side of the facade through the stamped out holes along the lugs to the front side of the top tile flange or of the facade tile top. Simultaneously owing to the compensation of play there is a one sided, i.e. front vertical ventilation gap between the top flange and the front bottom flange of the H section support girder.

In the case of another design of the facade tile structure in accordance with the invention lugs are partly stamped out of the middle web of the H section part of the support girder, such lugs being somewhat bent upward so that the bottom edge or the bottom flange of the top facade tile rides thereon and a horizontal air gap is formed between the same and the middle web. This arrangement offers the advantage that water running down the backs of the facade tiles may escape freely through the stamped out openings and is not retained by capillary action. Accordingly the bottom flanges of the facade tiles also dry more rapidly so that there can be no collection of moisture and staining in the bottom part of the facade tiles.

In the case of a further possible design of the facade structure in accordance with the invention both the connecting web of the H section support girder part as well the bottom flange of the facade tile is set obliquely, more particularly so as to slope downward and forward. This leads to the advantage that the lugs arranged in the web are bent out obliquely to the rear and thrust the top of the facade tile or the top flange to the rear so that there is the required compensation for horizontal play, an improvement in transfer of the water forward and an access gap in front of the top flange. Because of this and owing to the above mentioned obliquely set rear bottom edge of the bottom flange of the next facade tile there is the additional advantage that the bottom flange slides forward in the support girder and is present as well at the front top girder flange so that rattling of the facade tiles is prevented and on the rear side of the bottom girder flange there is a gap for the passage of water and for ventilation. The different form and thickness of the top and bottom flanges means that alignment of the front surfaces of the facade tiles is ensured.

In accordance with a further advantageous embodiment of the facade structure of the invention is contemplated to the effect that on the front bottom flange as well of the H section support girder lugs able to be bent are provided. Such lugs render possible compensation for the horizontal play between the top tile flange and the support girder so that the resilient girders normally present behind the facade tiles in order to prevent rattling noises in windy weather are no longer necessary.

Another design of the facade structure is, in accordance with which the ends of the flanges of the H section girder part are provided with reinforcements directed toward the internal side of the H section. It is an advantage with this design that the horizontal load transfer on taking up the force of the wind and more especially jerks is shifted from the top or bottom flange to the bottom thereof or directly to the facade tile bodies. Accordingly there is a substantially enhanced reliability as regards preventing fracture of the flanges, more particularly owing to jerk loads.

A further improvement is possible if the front, top flange of the H section support girder is made oblique at its top edge to slope forward and downward with the result that lifting of the facade tile to move its bottom flange into the support girder is facilitated.

A further improvement in this respect is if the rear bottom edge of the facade tile or of the bottom flange is correspondingly made oblique. This leads not only to the advantage of easier assembly but furthermore the advantage of an improved escape of water running down the back side of the facade tile at the lugs stamped to the front side of the facade tile and also to improved ventilation.

In the case of a further embodiment of the facade structure of the invention the rear flange, on the wall side, of the support girder is arranged so far down that it is opposite to the flanges of the H section girder part at generally the same level. The attachment of the support girder at its rear flange to the vertical main girders, secured to the wall of the building, is performed in this case from the front side through two coaxial holes in the lower flanges of the H section girder part. This arrangement involves the advantage that the resultant of the wind suction force is generally at the level of the axis of the attachment screw or of the rivet, with which the support girder is attached to the main girders. Accordingly the effective leverage of the greatest load part on the facade tiles, namely the edge suction wind suction load, will be very small in the case of high buildings, with the result that there will be a low torsion load on the support girder. Moreover in the case of such support girder there is no need to have the upwardly directed upper part of the rear flange, something leading to a reduction in weight and in costs.

In the design with the upper front flange of the H section support girder set somewhat obliquely so that the clearance width of the upper half of the H section support girder becomes narrower in a downward direction and accordingly the bottom flange will have its lower edge set against the support girder when acted upon by the suction force of the wind. As a result the suction force of the wind transmitted by the upper facade tile will be transferred further down to the support girder. If furthermore the lower front flange of the girder is provided with anchoring means at its lower end, the transfer of the suction force of the wind will be as low down as possible. Accordingly it becomes possible to arrange for the resultant of the wind suction forces to be lower down than the horizontal axis of the attachment for the support girder on the backing structure. The result of this is an upwardly turning moment resulting from the wind suction force, which is opposite to the moment resulting from the structure's own weight. Accordingly the resulting torsion moment can be minimized, something which has a good effect on the weight and costs of the support girder. While it is true that the wind pressure causes a moment, which is in the same direction as the weight of the structure, and adds to it, since however the wind suction force adjacent to edge of the building is substantially higher than the wind pressure, in the case of this optimization the effect of wind suction is more significant as regards the direction of the resulting forces. In the case of wind pressure the facade tiles are in contact at the two rear flanges so that owing to the position of the point of action of the upper inner flange upward (the lower flange needs a point of action which is as low as possible owing to the jerk loads) the resultant may be shifted upward past the attachment axis and accordingly also the wind pressure will cause a torque opposite to the weight of the structure with the result that the support girder may be optimized.

In the case of another advantageous embodiment of the resign of the invention, the web between the H section part and the rear flange of the support girder is arranged approximately on the two lower ends of the same. This means that there is a gutter which takes effect when more water is driven inward for a short time via the open horizontal joints of the facade by the wind than may be run off simultaneously through the openings in such web. Moreover, the gutter offers the advantage that water dripping downward is caught without the thermal insulation becoming sodden by spalsh from filling water.

In the case of a particularly advantageous form of the facade structure of the invention the part of the support girder on the wall side is partly in the form of a hollow cross section and partially in the form of an open C section. The hollow cross section leads to the advantage that the support girder has a substantially greater torsional stiffness and respectively for a given span leads to a marked saving in the use of material. Owing to additional open C section or flange-like part of the support girder there is the advantage that the support girder may still be rivetted or screwed to the vertical main girder without any substantially more elaborate attachment means being necessary because of the hollow section.

In a further development of the facade structure of invention the H section part is completely or partially lacking in flanges. The attachment and fixation of the facade tiles is in this design partly or completely performed by lugs, which are bent out of the horizontal flange, which bears the upper facade tiles, in a downward and upward direction, and fit into the upper or, respectively, lower grooves in the facade tiles. The advantage of this embodiment is that it is particularly suitable for the attachment of facade tiles with holes therein so as to resemble a honeycomb and which possess particularly good acoustic insulating properties. Such facade tiles, whose extrusion direction is perpendicular to the front surface of the facade, are cut off while still in a plastic state from a ceramic extruded mass or, in the fired condition, from a massive perforated structure and owing to their different direction of extrusion may not be extruded with a top and/or bottom flange. Instead of top and bottom flanges it is however possible for grooves to be sawn or milled in the frame without any great effort, into which grooves the flanges and/or the lugs of the support girder fit. A further advantage is that the top and the bottom grooves may be produced with exactly the same size and exactly symmetrically to one another with the result that production technology of such ceramic honeycomb facade tiles is substantially simplified. An additional advantage is that climbing plants thrive on such honeycomb ceramic facade tiles and do not damage same and, when there is a heavy frost, are not "frost burned" by contact with metal frames or brackets. The lugs can be naturally fitted from above and/or form below into the vertical holes in the facade tiles, whose extrusion direction is vertical.

The facade structures in accordance with the invention are naturally not limited to horizontal support girders and facade tiles with horizontal holes. All the previously noted embodiments, and those yet to be described can be utilized in connection with vertical support girders and/or with facade tiles having vertical holes.

In the case of another form of the facade structure of the invention the lower half of the H section part of the support girder is set offset to the rear, that is to say toward the wall of the building so that when the front side of the upper and lower facade tiles are aligned the lower facade tile may be designed with a substantially larger overall depth. This leads to the advantage that in the lower part of facades it is possible to arrange facade tiles with a substantially greater resistance to impact without more expensive design being necessary for the entire facade. The slight reduction in the moment of resistance of the support girder about the Y axis is insignificant in this respect, since in the lower part of the building wind forces are smaller. Naturally it is also possible for the upper half of the H section part to be set back in relation to the lower half, if in some exceptional cases it is only as from a certain level of the facade that a reinforced design of the facade tiles should be required.

In the case of another possible design of the facade structure the holes in them are grouted with a heavy filler to achieve a substantially enhanced resistance to impact. It has been shown empirically that the impact strength increases at a rate which is more than proportional to the increase in weight. By grouting reinforcement rods, preferably of stainless steel, in place there is not only a further increase in weight but also the additional advantage that any crack, produced by impact, in the facade tile will not lead to the tile's breaking apart.

In a further embodiment of the facade tile in accordance with the invention the support girders are pre-mounted to give frame-less box structures, in the case of which the support girders are attached to two rear main girders at the 1/5 point and the 4/5 point of the overall length L1, such rear main girders for their part being attached to the wall of the building. This design offers several substantial advantages. Such advantages are on the one hand that owing to the loading of the support girder as cantilever arms with a span of 3/5×L1 and cantilever extensions on each side of 1/5×L1 the moments of flexure and accordingly the stressing of the material owing to wind and weight loads merely amount to approximately ⅙ of the flexure moments which would occur in the case of a full span of 1×L1. Accordingly in the case of given support girders the overall width of the box structure may be increased by practically 2.5 times; or it is possible, for a given overall width to utilize substantially lighter support girders. Furthermore, the transfer of the load takes place along the shortest possible path directly to the main girders, which for their part are, with advantage, attached to the building at the 1/5 and 4/5 points of their overall vertical length $L_2$, and consequently may be designed with a particularly light weight. Heavy and expensive box designs may therefore be completely abandoned. If for decorative purposes a surrounding box frame should be desired, same may be provided in a very light, non-load bearing design mounted on top of the box structure. A further advantage is that the support girders and the main girders do not abut each other end to end, but at all points of intersection make contact with one surface placed against the other so that low-cost joining techniques may be employed, such as welding, screwing or riveting to give an extremely stiff box design. Similar advantages are to be achieved using vertical support girders and horizontal main girders.

In accordance with a further embodiment of the facade in accordance with the invention the problem of thermal expansion of the support girders is solved, which becomes more serious in the case of the increased spans of the structure than it has been so far. The problem is that for anchoring the main girders to the wall of the building simple wall angle cleats are conventionally employed, on which the continuous main girders are attached. In the case of the temperature variations likely at the facade of ±50 K and a thermal expansion of aluminum of $2.5\times10^{-5}$ there will frequently be a plastic deformation of the wall angle cleats, permissible stresses being substantially exceeded. The solution to this problem is that the wall angle cleat is not simply bent once but is additionally bent in the form of a single or multiple meander so that, for a given flexural load, there is a substantially greater deformation stroke available. It follows from this that for the same deformation owing to the change in length of the support girders there will be substantially smaller stresses in the wall angle cleat. In the case of a displacement of the support girder end owing to thermal expansion to the left both limbs, which are arranged perpendicularly to the facade surface, of the angle cleat will deform as indicated by the chained line in FIG. 14 so that the support girder end may shift by the differential length $\Delta l_1$ to the left. The possible displacement permissible without exceeding the stress of the support girder secured to the multiply bent, meandering wall angle cleat amounts to $\Delta l_2$ and is substantially greater than $\Delta l_1$. The particular advantage of this design is that the length compensation at the so-called sliding point does not involve sliding at a rivet joint with a slot but only involves elastic bending of a thin walled separate part. Accordingly frictional effects, which often enough lead to locking of the sliding function, are out of the question.

Another embodiment of the design in accordance with the invention is such that the wall cleats, which are laterally elastic, are also able to be employed in the vertical direction—i.e. perpendicularly to the plane of the drawing—as sliding points for thermal expansion of the vertical main girders. Normally the selection of a sliding point of this type is such that the main girder is riveted with play on the wall angle cleat using one flat rivetting template, only placed between the girders during the riveting operation, the cleat being provided with a slot. The round hole in the other main girder is only drilled, dependent on the necessary degree of overlap between the wall angle cleat and the main girder—that is to say dependent the necessary wall clearance—just before rivetting. In the case of stainless steel girders this leads to difficulties to the extent that such a girder may only be drilled with great difficulty on the construction site owing to its hardness. Conventionally this problem is so solved that aligned with a row of slots placed close to one another in the wall angle cleat there is an opposite dense area pattern of round holes in the associated limb of the main girder. Accordingly it is always feasible to find a round hole, which is in exact alignment with one of the slots. A disadvantage in this respect is elaborate system of stamped holes and slots and the weakening of the girder cross section occasioned thereby. The design of the invention is to the effect that a simply or multiply meandering bent sliding shoe is inserted in a movable manner in the wall angle cleat, a free flange thereof being provided with a row of closely spaced holes and on the flange of the vertical main girder as well only one or a few rows, placed one after the other with well spaced round holes are arranged. By shifting the sliding shoe the necessary overlap in the vertical direction is produced; the horizontal overlap is produced by the closely spaced row of slots in the sliding shoe. The advantage of this design lies more particularly in the case of stainless steel in the fact that no holes must be drilled on site, and furthermore no girders with a close pattern of holes are necessary.

A further advantageous embodiment of the facade design in accordance with the invention is that the support girders are grippingly enveloped by the facade tiles or, respectively, the top and bottom flanges thereof at the back and at the front. The advantage of this is that the support girders are not arranged on the rear side uncovered and so as to be visible, but rather between the facade tile flanges substantially concealed, something which in the case of assembly in surrounding box frames may be desired by the architect. A further advantage is that the cross sections of such facade tiles are substantially symmetrical so that greater accuracy is feasible in the production thereof.

It is naturally possible for all above mentioned methods for the compensation of vertical and/or horizontal play in the form of pins or bent lugs to be employed here as well. The analogous application of the different other embodiments described, more particularly for holes and slots in the support girder for ventilation and for the escape of water, is possible in the case of support girders which are arranged so as to be covered as described.

It is an advantage if access for bending the lugs is by using a tool in the form of a key with a bit, which is inserted with one end of its shank as an axis of the rotation into an opening in the vertical web of the support girder so that by turning the key the bit will act on the lugs bending same. The particular advantage lies in simple and rapid assembly.

In the case of a particularly advantageous design the support girders have a C section, a double T section or a double C section so that they also remain concealed behind open tile joints, if in the interior of the girder they are colored dark. A further advantage of such girders is that on replacement of individual facade tile through the tile joints and the open girders the lugs necessary for compensation of play are still accessible. The replaced facade tile does therefore not have to be grouted with silicone rubber to prevent same dropping out or being removed, since they may be secured by bending the lugs.

A further advantageous development of the concealed support girder design of the invention is a question of the concealed attachment of window sill tiles to the backing structure. In this case the window sill tile is placed on two support girders and shifted so far forward parallel to itself that the girders or parts thereof have one respective flange bar of the window sill tile fitting underneath it and the window sill tile is prevented from being lifted. In order to prevent any later displacement of the window sill tile in the opposite direction and lifting thereof, on one or both of the two girders a lug is bent out so far that its lies with or without play on the facade tile. The particular advantage of the design is that assembly is very simple and reliable and that the support girders are fully concealed from the outside of the facade and from the rear side are substantially concealed.

A particularly practical further development of the invention is the concealed attachment of window lintel tiles. In this case the window lintel tile is shifted for attachment to two support girders because two flanges of the same envelop the girders or parts thereof from above, and prevent same from falling out. Later displacement of the lintel tile in the opposite direction and dropping out thereof is prevented by bending the lugs out from one of the girders or by driving in securing screws into one of the girders. The particular advantage is here as well that there is a simple and reliable form of assembly and furthermore that the girders are completely concealed from the outside of the facade and from the rear side are substantially concealed.

In the case of a further embodiment of the facade design, the support girders are concealed in the interior of the slots of the facade tile. In this respect the support girders may have practically any desired cross section as a round tube, four sided tube, or a structure with a U cross section, a C cross section or the like and are provided on one or more outer surfaces with respective rows of obliquely outwardly bent lugs for compensation of horizontal and vertical play and for the compensation of inaccuracy in molding. Although the facade tiles must be "threaded" on two respective support girders, the design does however offer the advantage of particularly great reliability as regards separate parts falling out of place when subject to impacts, since the resilient lugs substantially absorb the impact or jerk.

A particular form of the facade tiles with an internally arranged support girder is a shade leaf or louver element. In this case several facade tiles are threaded with together with spacers and means preventing rotation on preferably one central support girder with resilient lugs and grippingly fixed in place on the support girder by flanges secured from either side at the ends of the support girders. A rotatable bearing means is produced by trunnions screwed into both ends of the support girders, which trunnions for example rotatably fit into corresponding eyes in a box structure. The advantage of this design is that even brittle ceramic facade tiles may be elastically attached to the support girder and accordingly are also suitable for moving parts, as is sometimes desired by architects for reasons of appearance.

A highly practical design is defined in the case of which the one trunnion is provided with a right hand thread and the other with a left hand thread on the opposite end is screwed into the support girder and both trunnions are able to be secured against rotating by, for example, having a four sided form. This design offers the advantage that the bearings may be produced even without using tools in box frames which are not accessible from the side because the joints are too narrow. Before fitting the finished shade leaf in the lateral box walls the two trunnions are screwed into the support girder practically completely, that is to say but for a few millimeters of length so that owing to the joint gap provided a movement into position of only a few millimeters of the trunnions is necessary into the holes provided in the lateral box walls for this purpose. By turning the shade leaf several times about its longitudinal axis (in the correct direction of rotation) the two trunnions will be screwed out of the support girder like releasing a turnbuckle. Accordingly there will be a reliable bearing means, since in their operational state the shade leaves may be turned, using a lever which is also clamped in place, through only 180° at the most about the longitudinal axis thereof.

A further particularly advantageous design of the facade in accordance with the invention is to the effect that support girders of the design are symmetrically put together as a double support girder. In this respect it is possible to completely dispense with the attachment flanges arranged in the plane of symmetry so that the two H section girder parts are only connected together by a central web. It is however also feasible to arrange such attachment flanges further apart and at the top and bottom to join the same together as a support girder in the form of a hollow box. The advantage of this design is that such support girders may be covered on either side by a facade and that dependent on the particular form and size the necessary moment of resistance about the X axis (for the weight of the structure) and about the Y for wind loads may be provided by the designer. This design is particularly suitable for large spans, as for example in the case of acoustic protection screens.

A further possible form of the invention having substantial advantages is such that the design with the hollow box section is made up of two symmetrically arranged support girders, which in their center plane are joined together by vertical and diagonal flat girders in such a manner that a trussed girder is constituted. The particular advantage of such design is that several support girders arranged in pairs one underneath the other and joined together by vertical and diagonal flat girders, possess in a vertical direction a very much larger load bearing capacity than the sum of the load bearing capacities of all pairs of support girders. Accordingly it becomes possible to span the width of 4 meters conventional on German roads and freeways using very light and thin walled support girder structures. In this respect it is essential that in the case of such acoustic screens the pre-mounted wall elements with a length of 4 meters whether covered by facade tiles or not may be lowered by cranes into the support posts arranged 4 meters apart. By a combination of elements with different overall heights, for example 1,000 mm, 600 mm and 400 mm it is possible to assemble an acoustic protection screen with any desired height in steps of 200 mm. In the horizontal direction, that is to say as regards wind loads, it is possible for the resistance moment Wy about the vertical y axis to be enhanced by increasing the outer wall thicknesses, more particularly the outer flanges of the H section girder parts. Naturally it is also possible to combine vertically arranged support girders with horizontally and diagonally arranged girders to provide a trussed structure.

In the case of another design for the facade structure of the invention, a front limb of the H section support girder is toothed, whereas the front limb is made smooth. The advantage of this design resides in the fact that it is also suitable for the fixation of extruded facade tiles with vertically arranged holes, if the hole to hole spacing and tooth pitch are made to match one another. It is an advantage in this case if the continuous half of the H section fits around the top flange of the lower facade tile thereunder, whereas the toothed flange on the top side fits from below into the holes of the upper facade tile. In the case of unflanged tiles the webs between the slots must be removed from the tile into which the continuous flange fits. Owing to this design the advantage of satisfactory transfer of the water through the slots in the facade tiles as well is provided for. Moreover, the facade tiles are prevented from sliding sideways by the engagement of the teeth in the slots.

The following description will serve to explain various different embodiments of the invention with reference to the drawings in detail and by way of example.

Figure 5A:
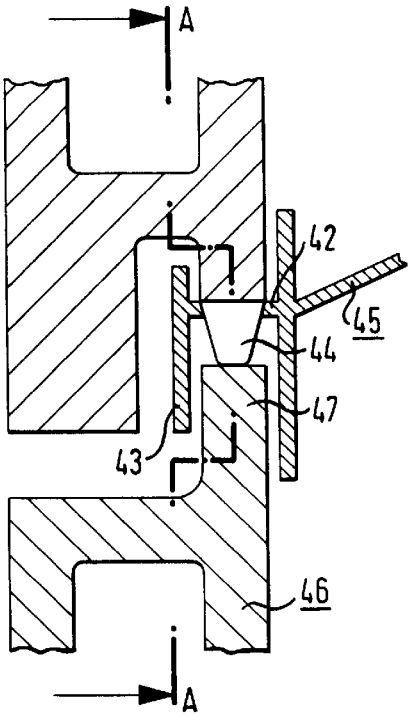

FIG. 5*a* shows a vertical section perpendicular to the surface of the facade.

Figure 5B:
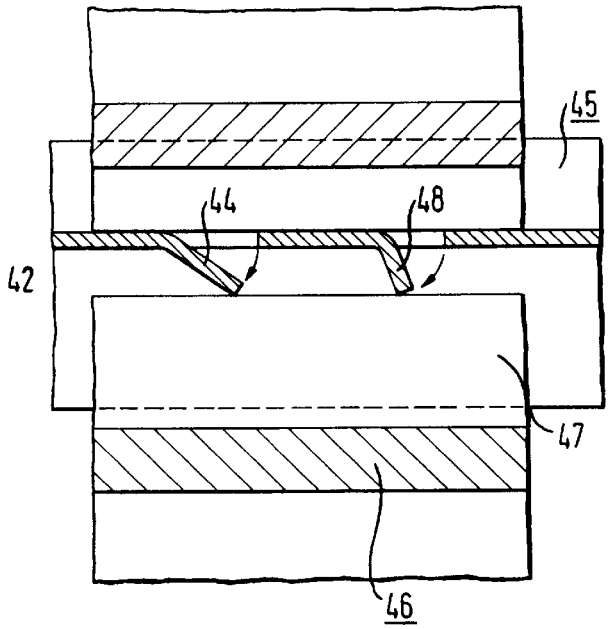

FIG. 5*b* shows a vertical section AA parallel to the surface of the facade.

Figure 5C:
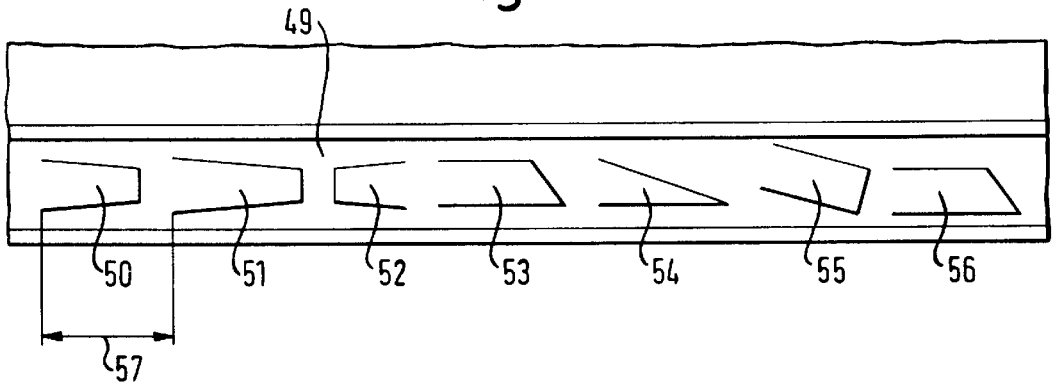

FIG. 5*c* shows a plan view of a support girder.

Figure 6A:
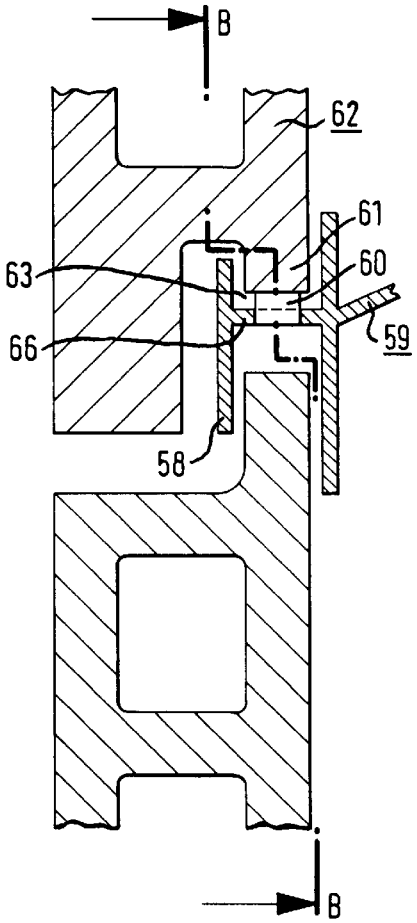

FIG. 6*a* shows a vertical section perpendicular to the surface of the facade.

Figure 6B:
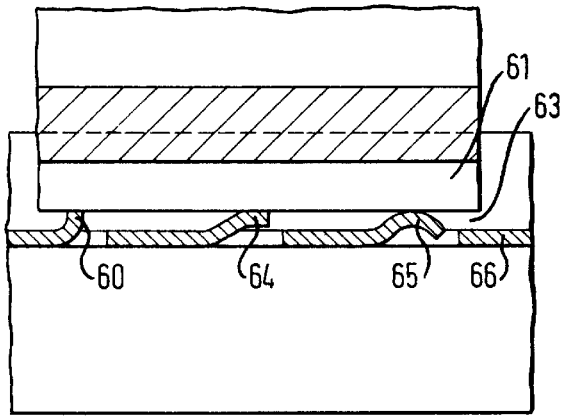

FIG. 6*b* shows a vertical section BB parallel to the surface of the facade.

Figure 7:
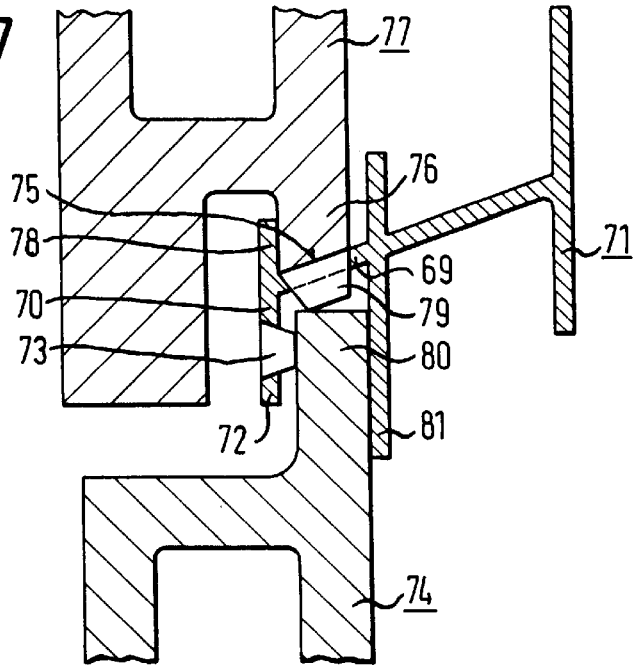

FIG. 7 shows a vertical section.

Figure 8:
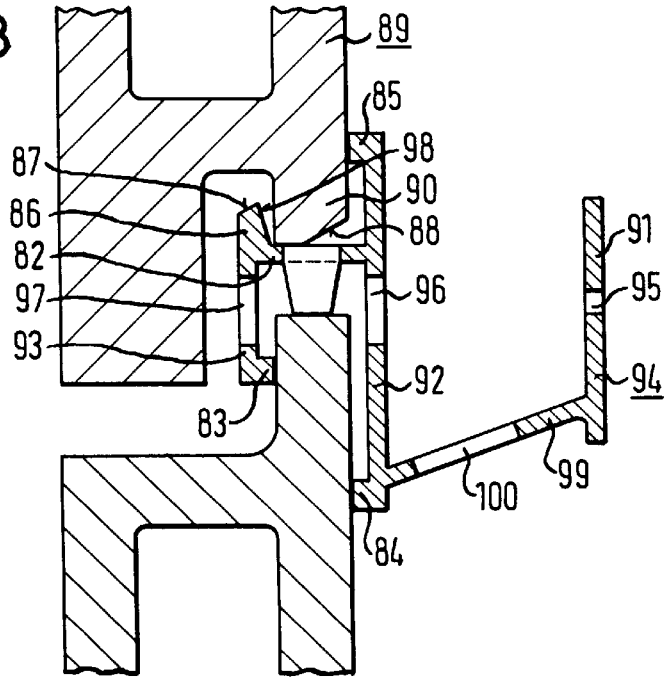

FIG. 8 shows a vertical section.

Figure 9:
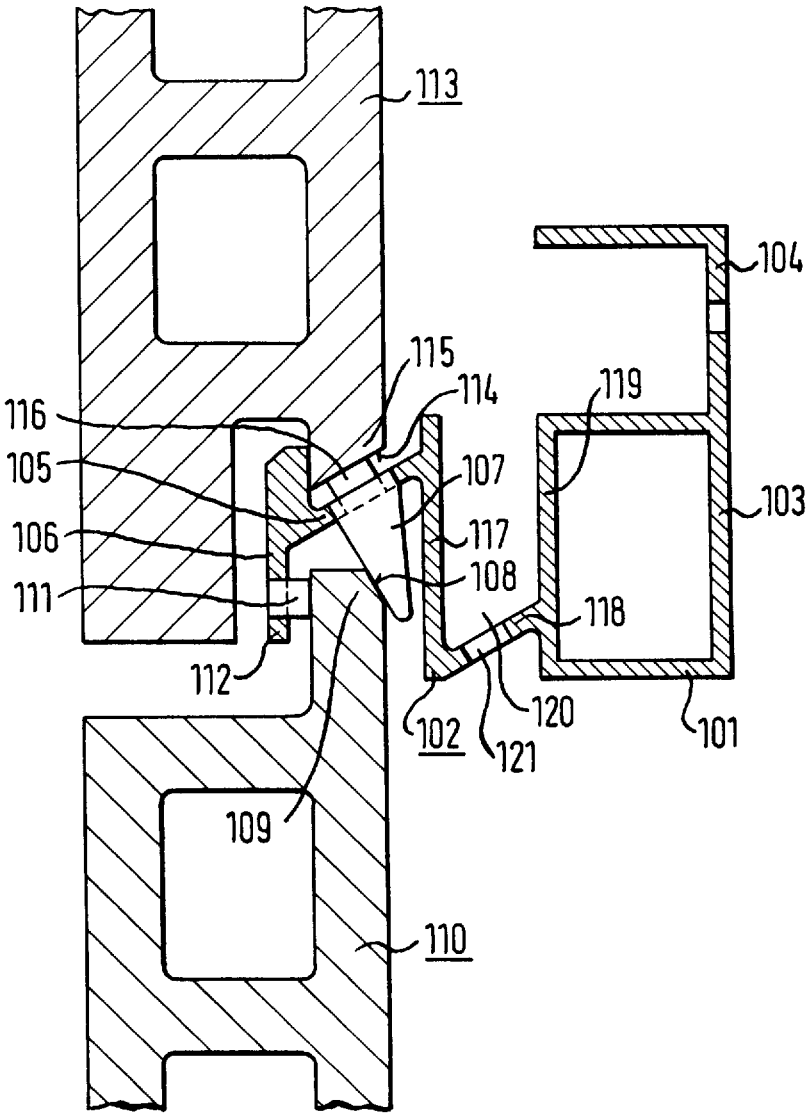

FIG. 9 shows a vertical section.

Figure 10:
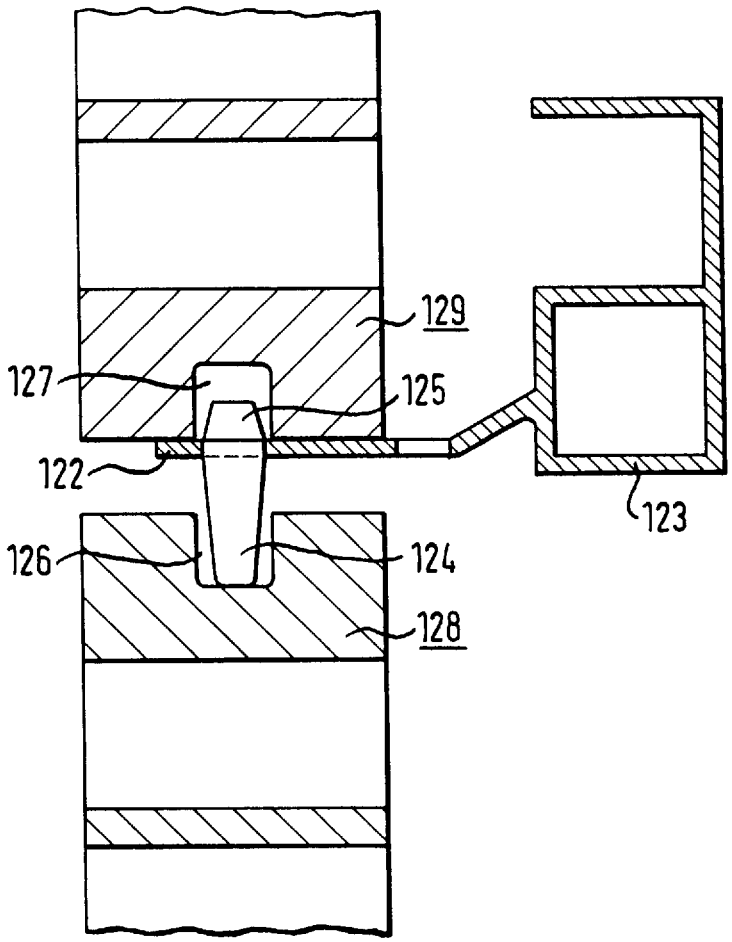

FIG. 10 shows a vertical section.

Figure 11:
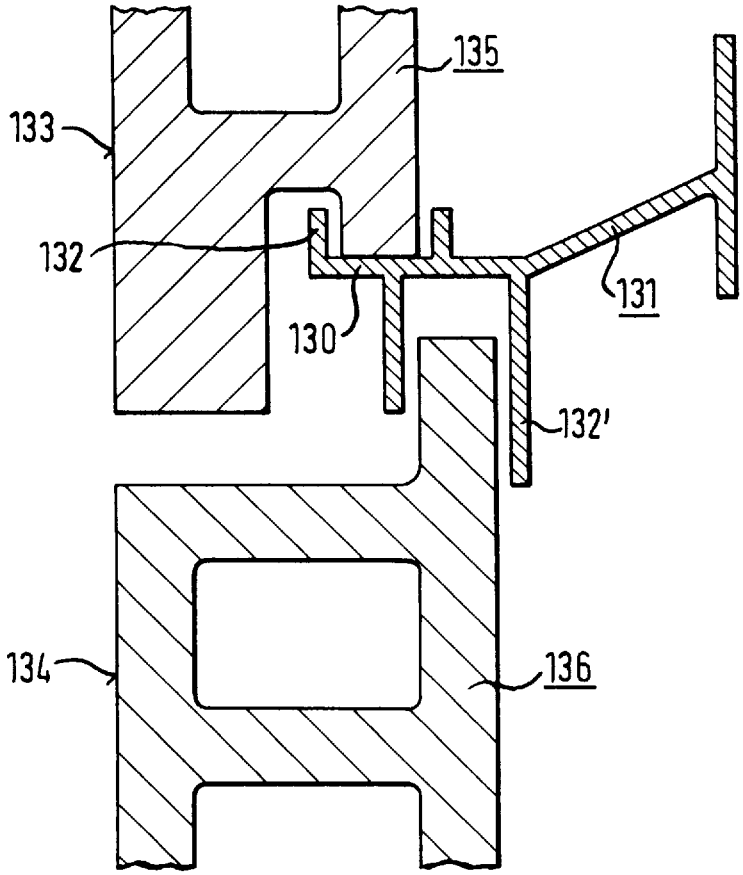

FIG. 11 shows a vertical section.

Figure 12:
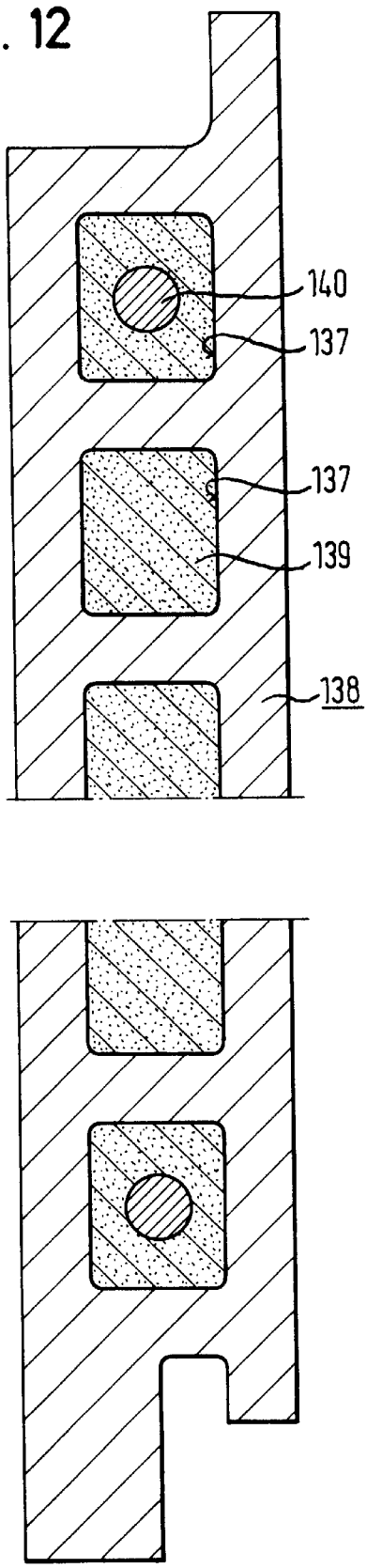

FIG. 12 shows a vertical section.

Figure 13:
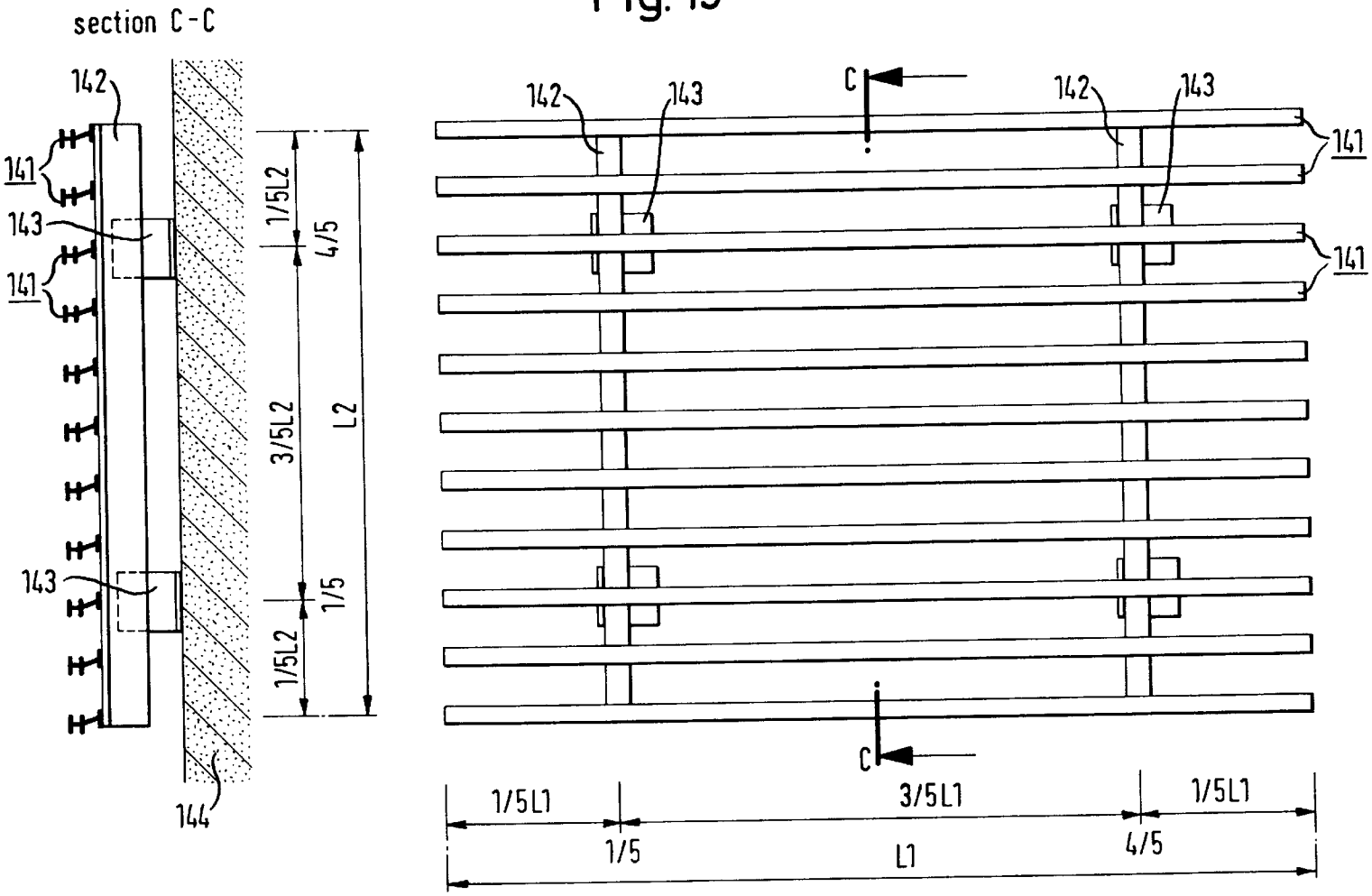

FIG. 13 shows a view from the front and a vertical section CC.

Figure 14:
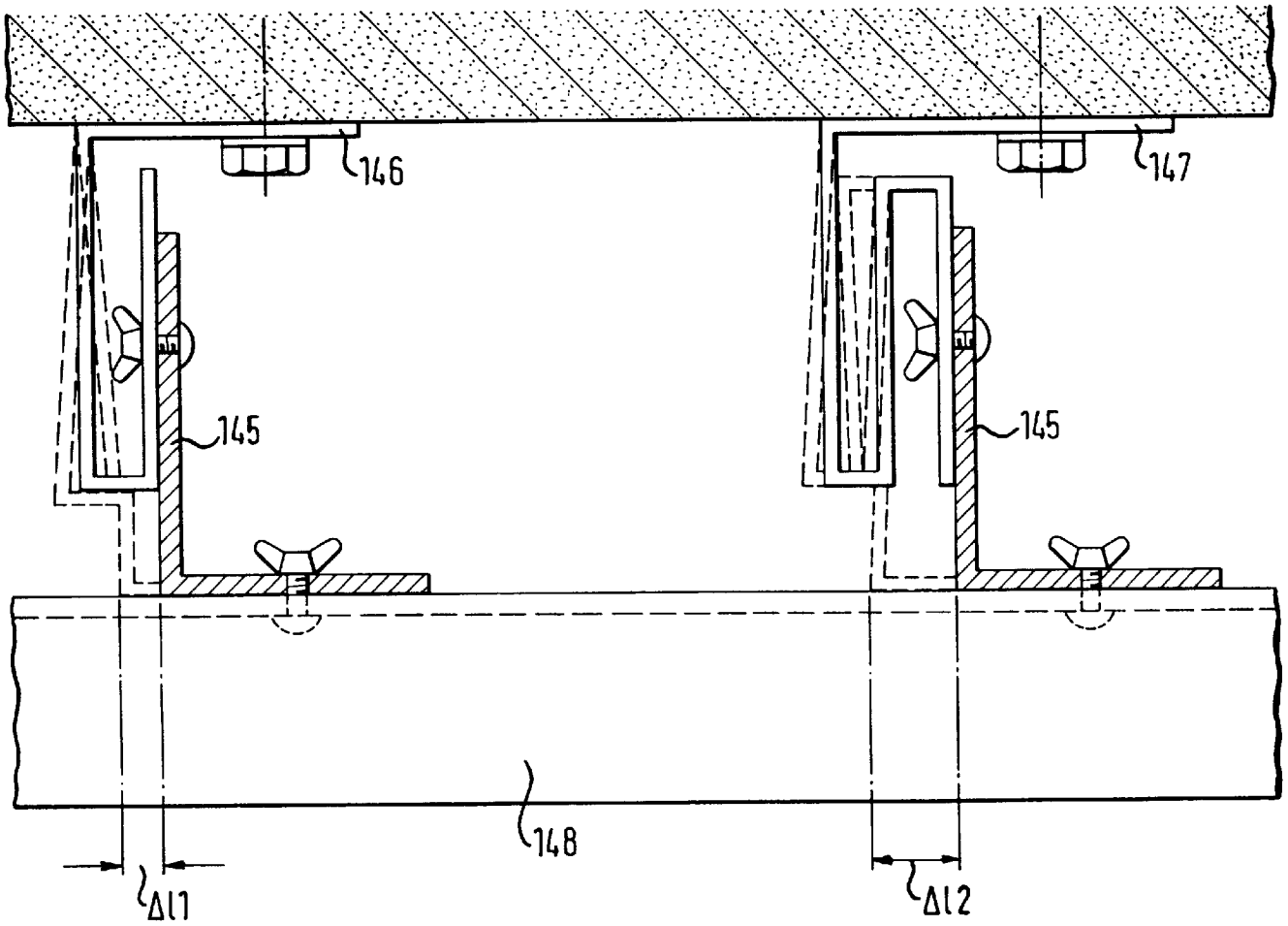

FIG. 14 shows a vertical section.

Figure 15:
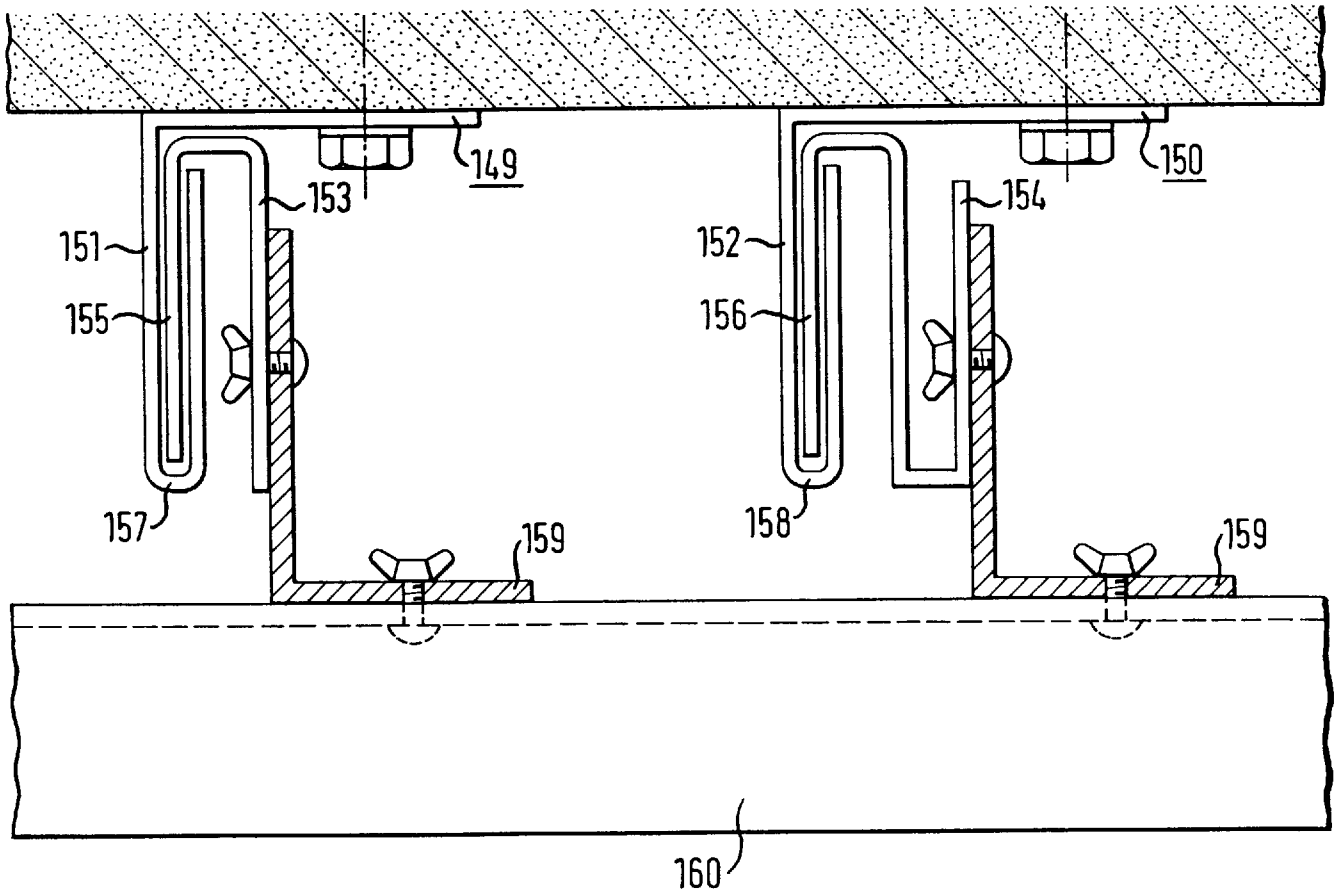

FIG. 15 shows a vertical section.

Figure 16:
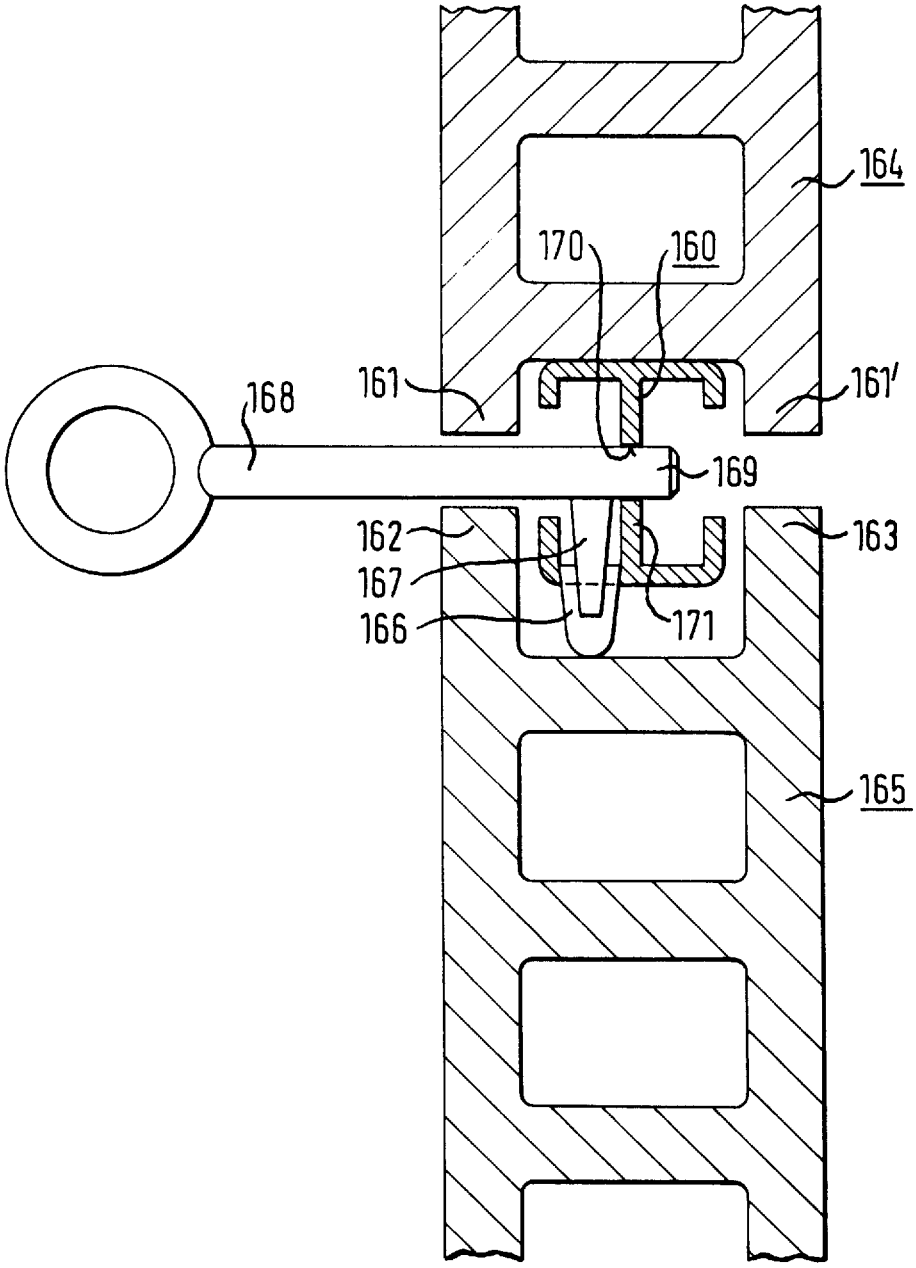

FIG. 16 shows a vertical section.

Figure 17:
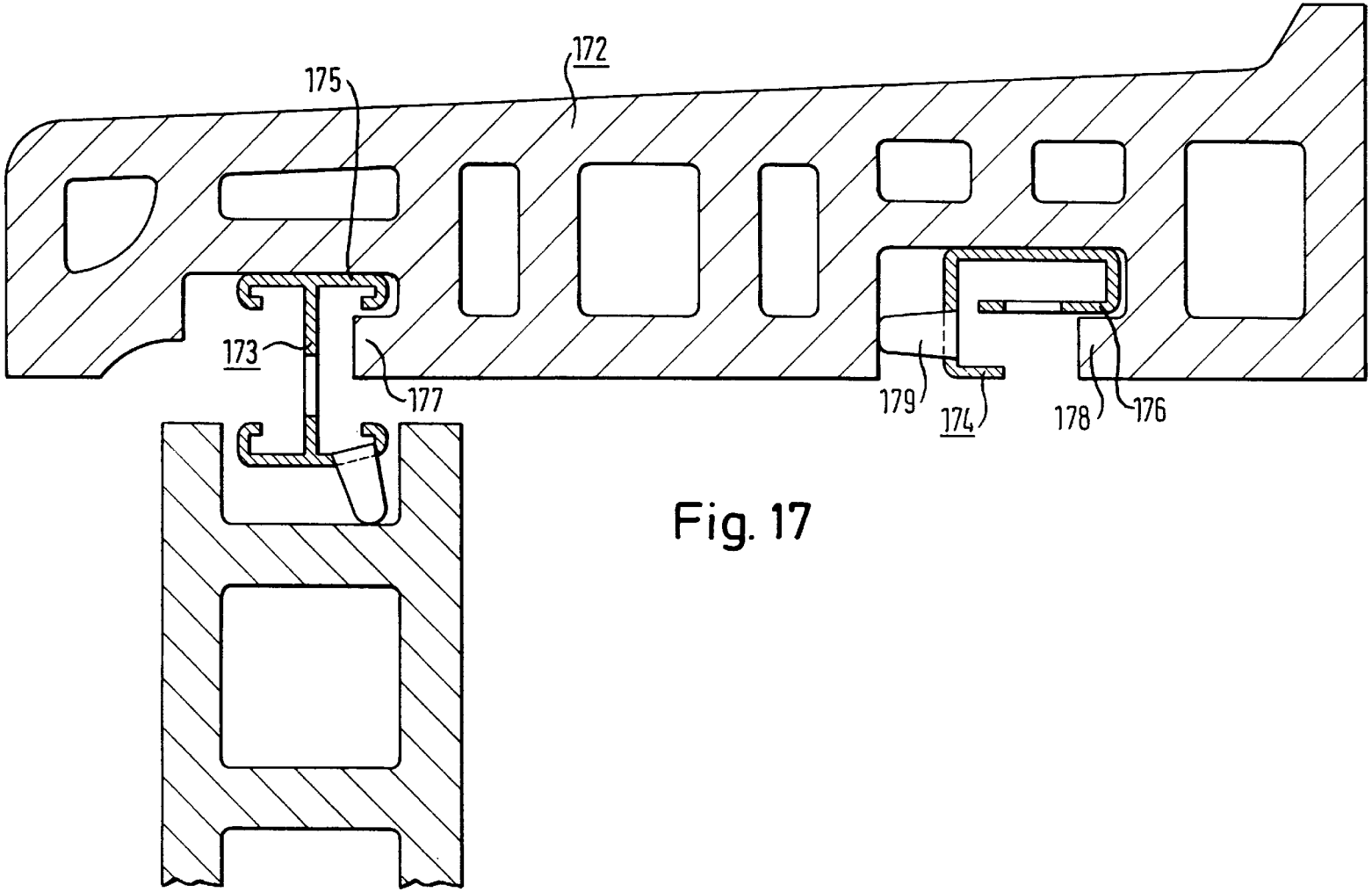

FIG. 17 shows a vertical section.

Figure 18:
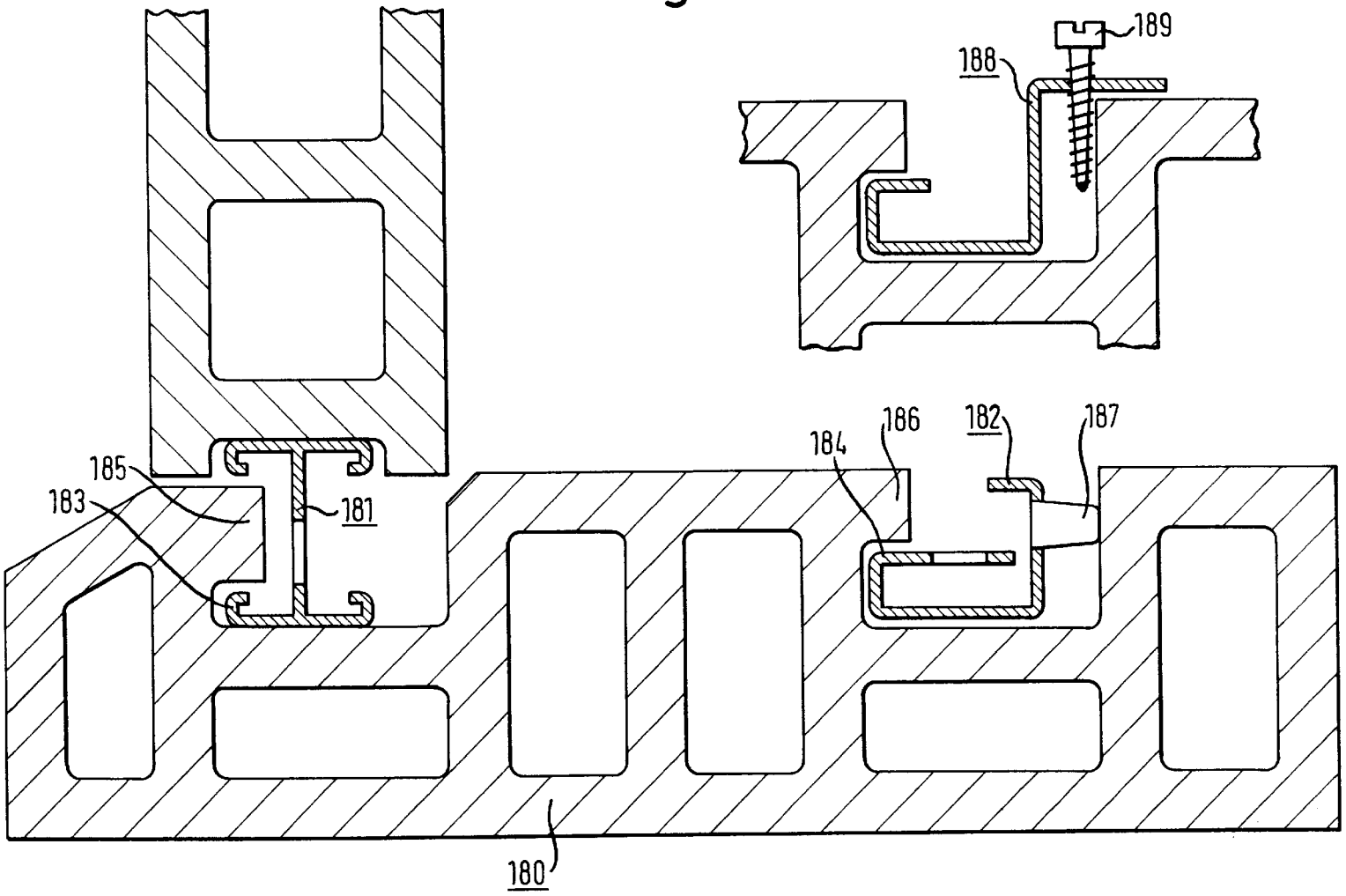

FIG. 18 shows a vertical section.

Figure 19A:
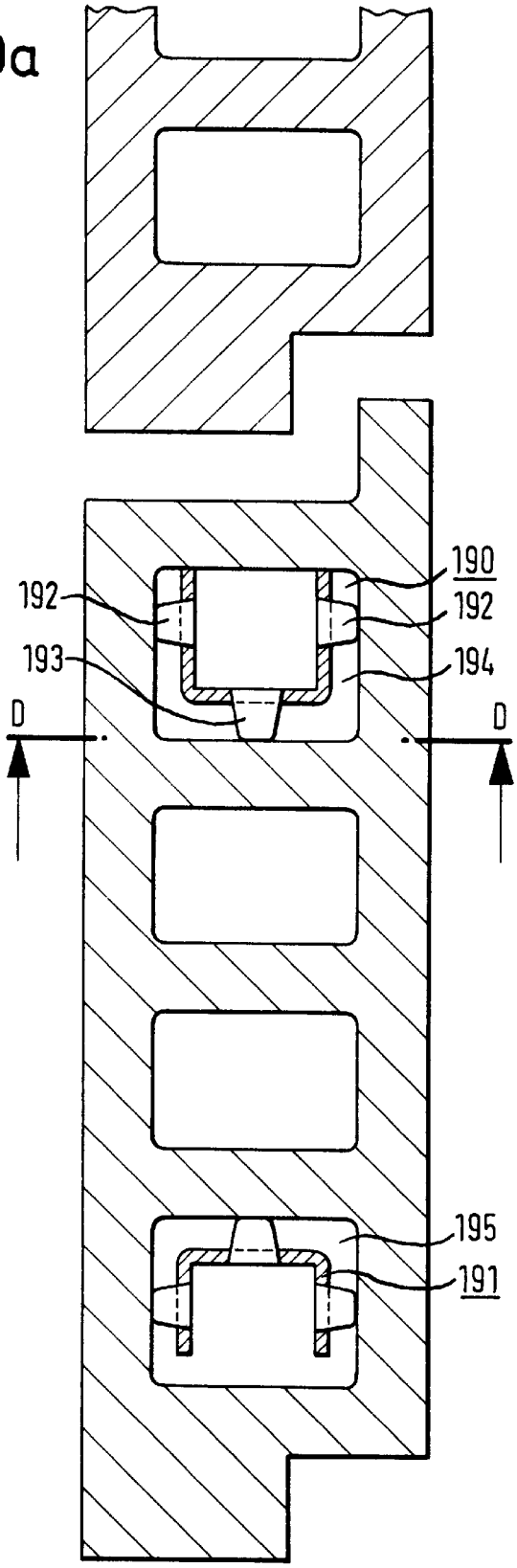

FIG. 19*a* shows a vertical section.

Figure 19B:
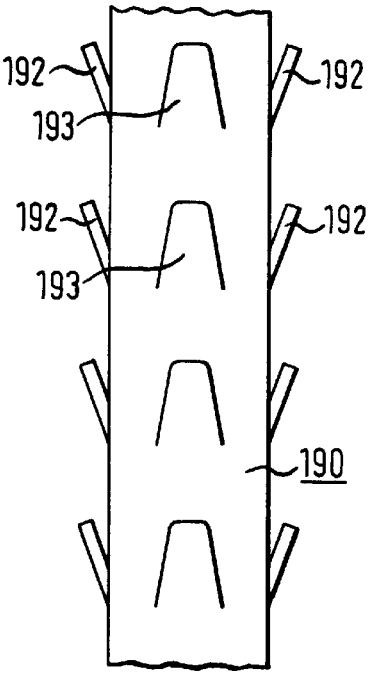

FIG. 19*b* shows an elevation of a support girder.

Figure 20A:
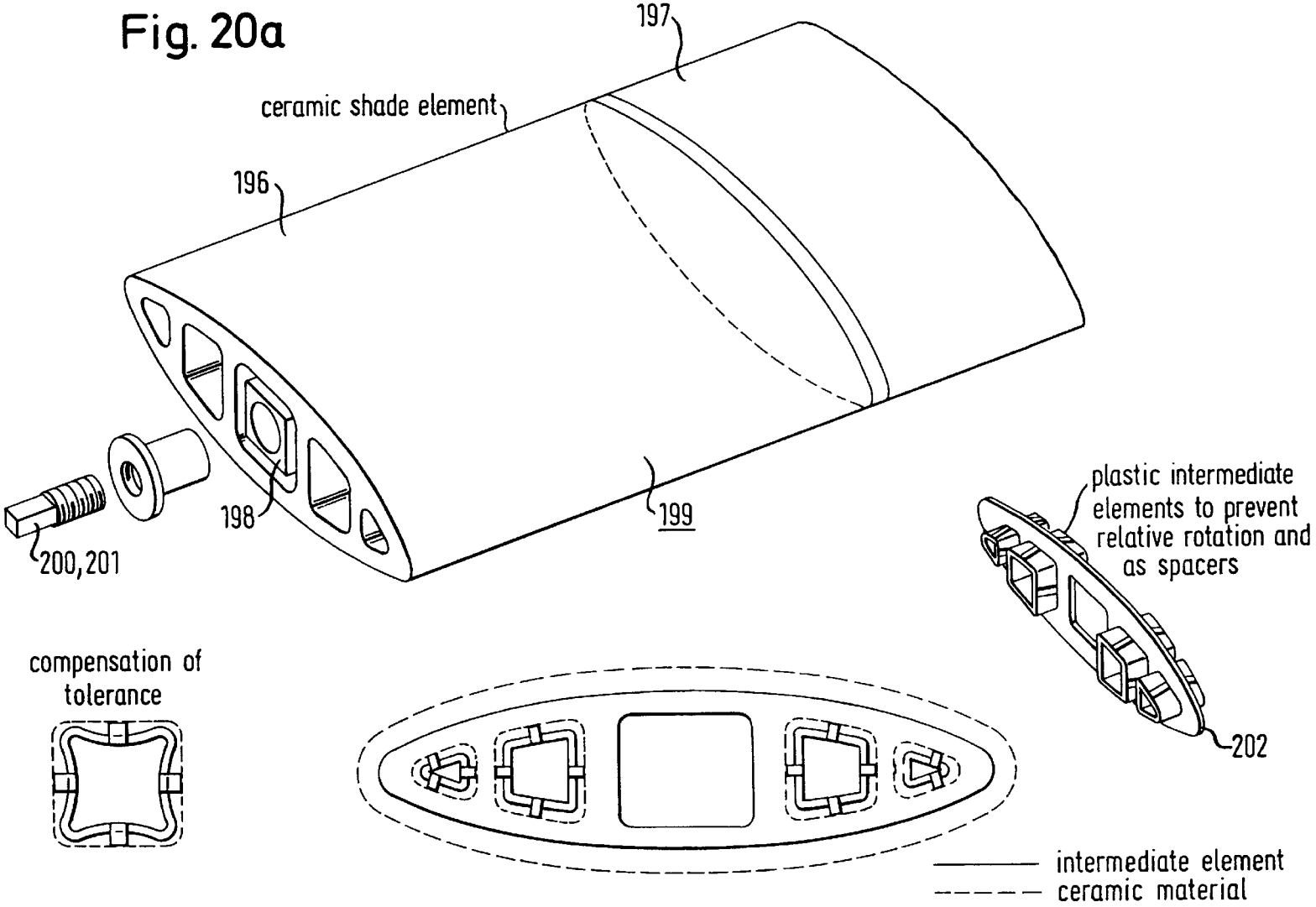

FIG. 20*a* shows a perspective view.

Figure 20B:
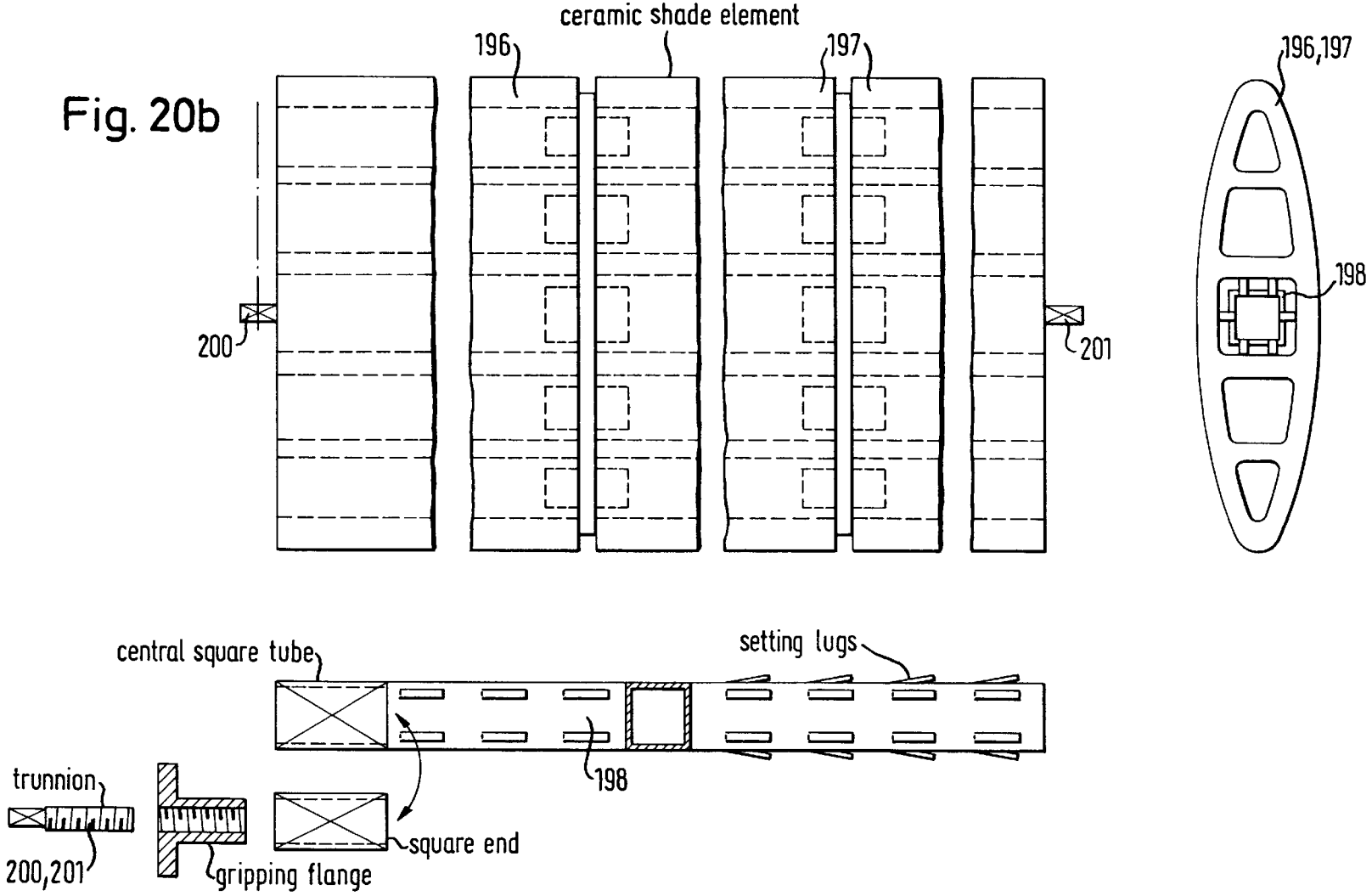

FIG. 20*b* shows elevations and sections.

Figure 20C:
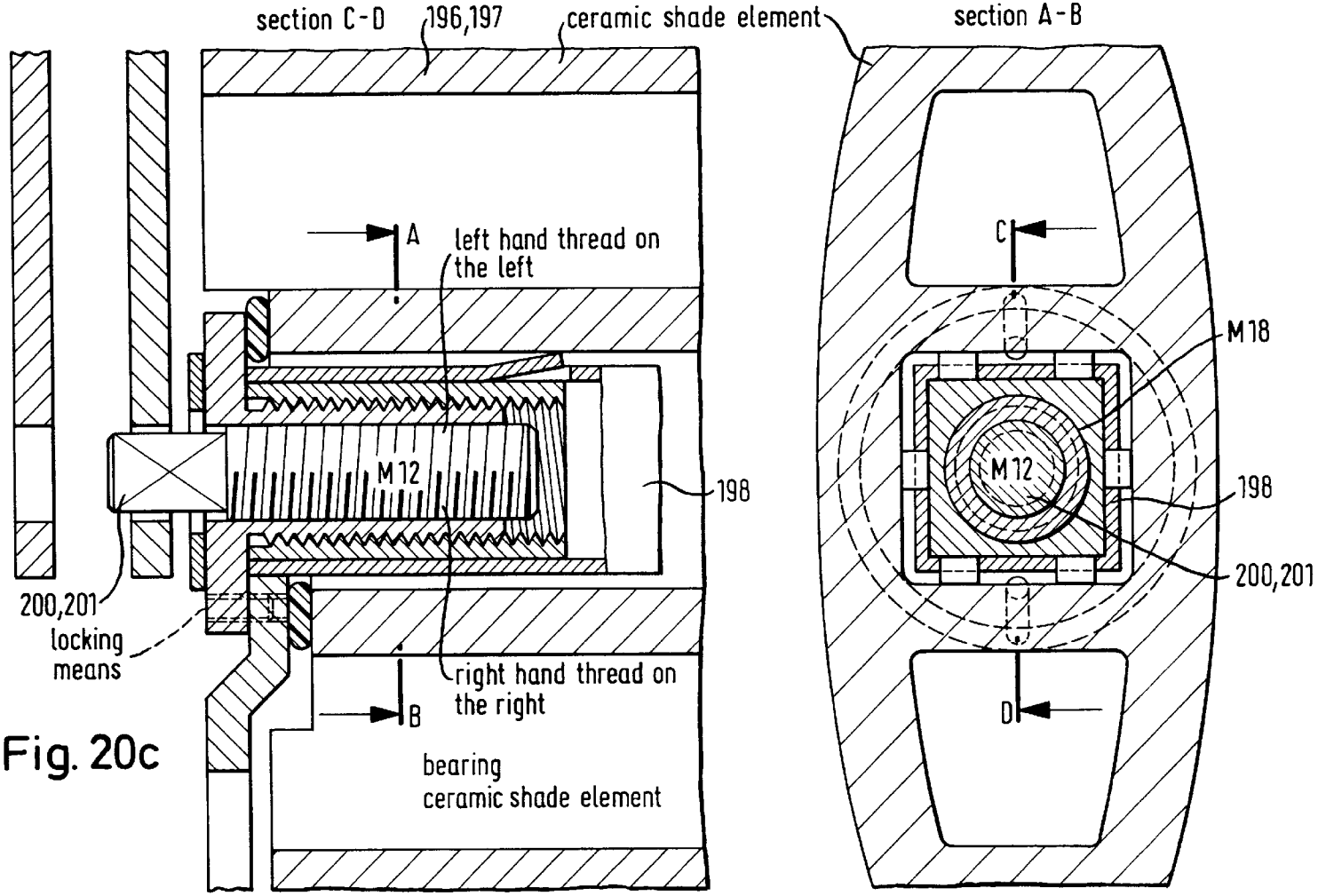

FIG. 20*c* shows a transverse section.

Figure 21A:
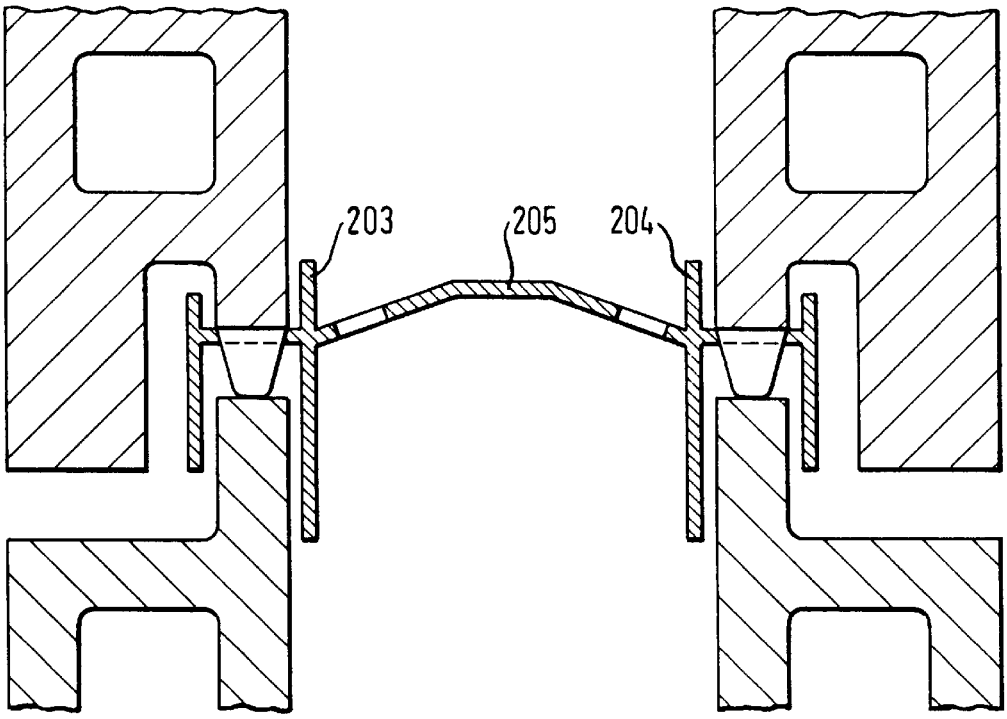

FIG. 21*a* shows a vertical section.

Figure 21B:
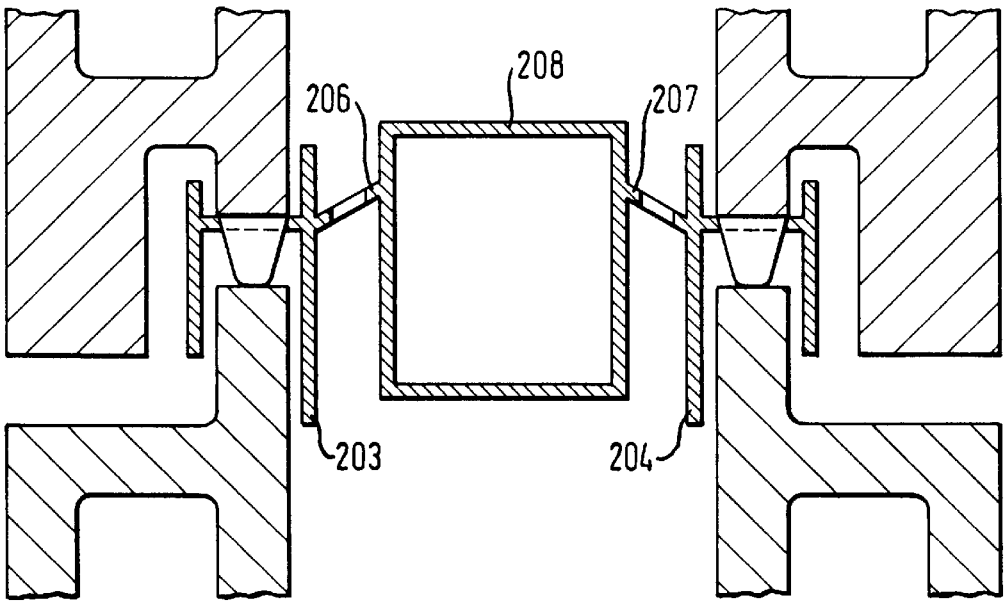

FIG. 21*b* shows a vertical section.

Figure 22A:
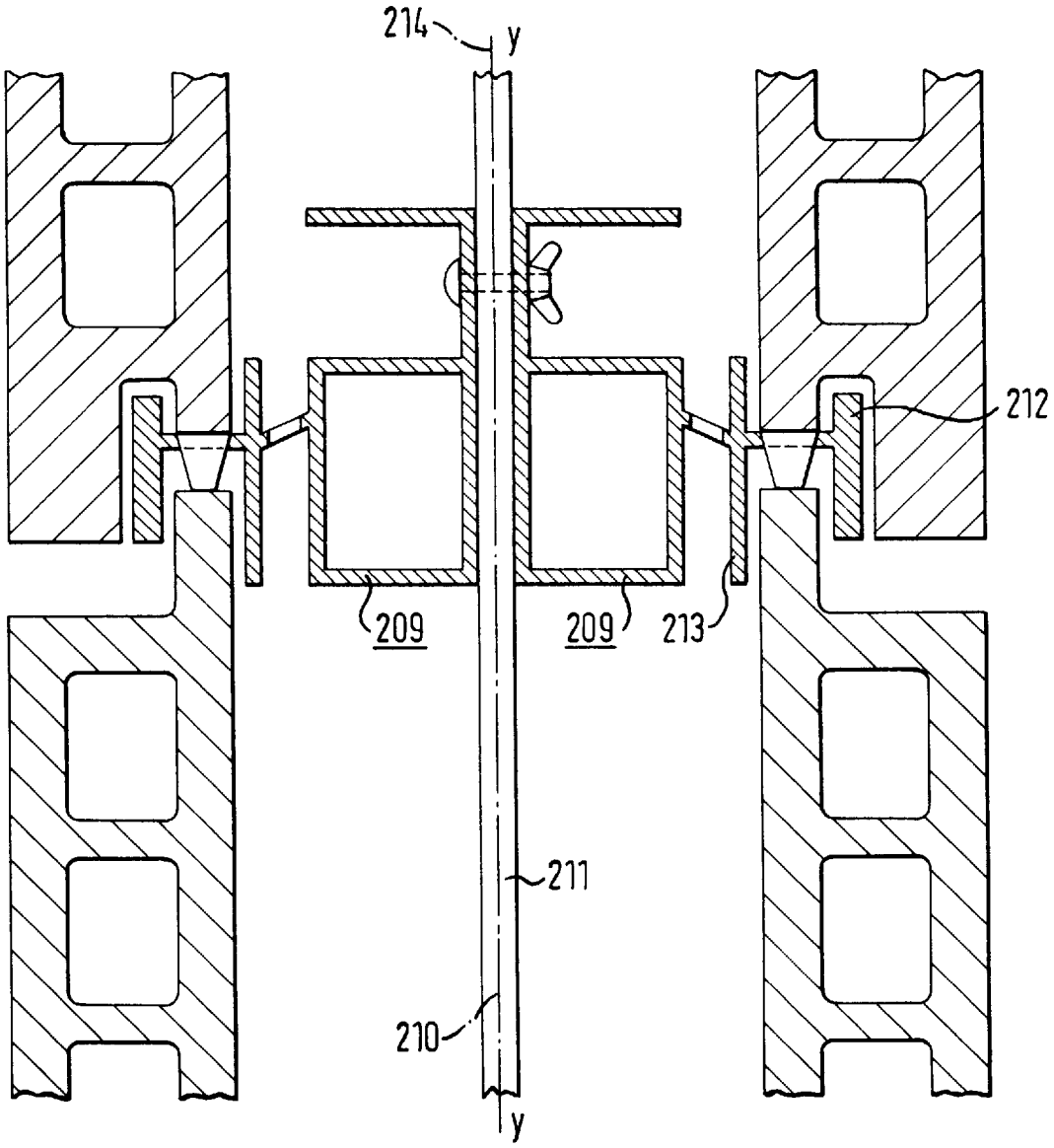

FIG. 22*a* shows a vertical section.

Figure 22B:
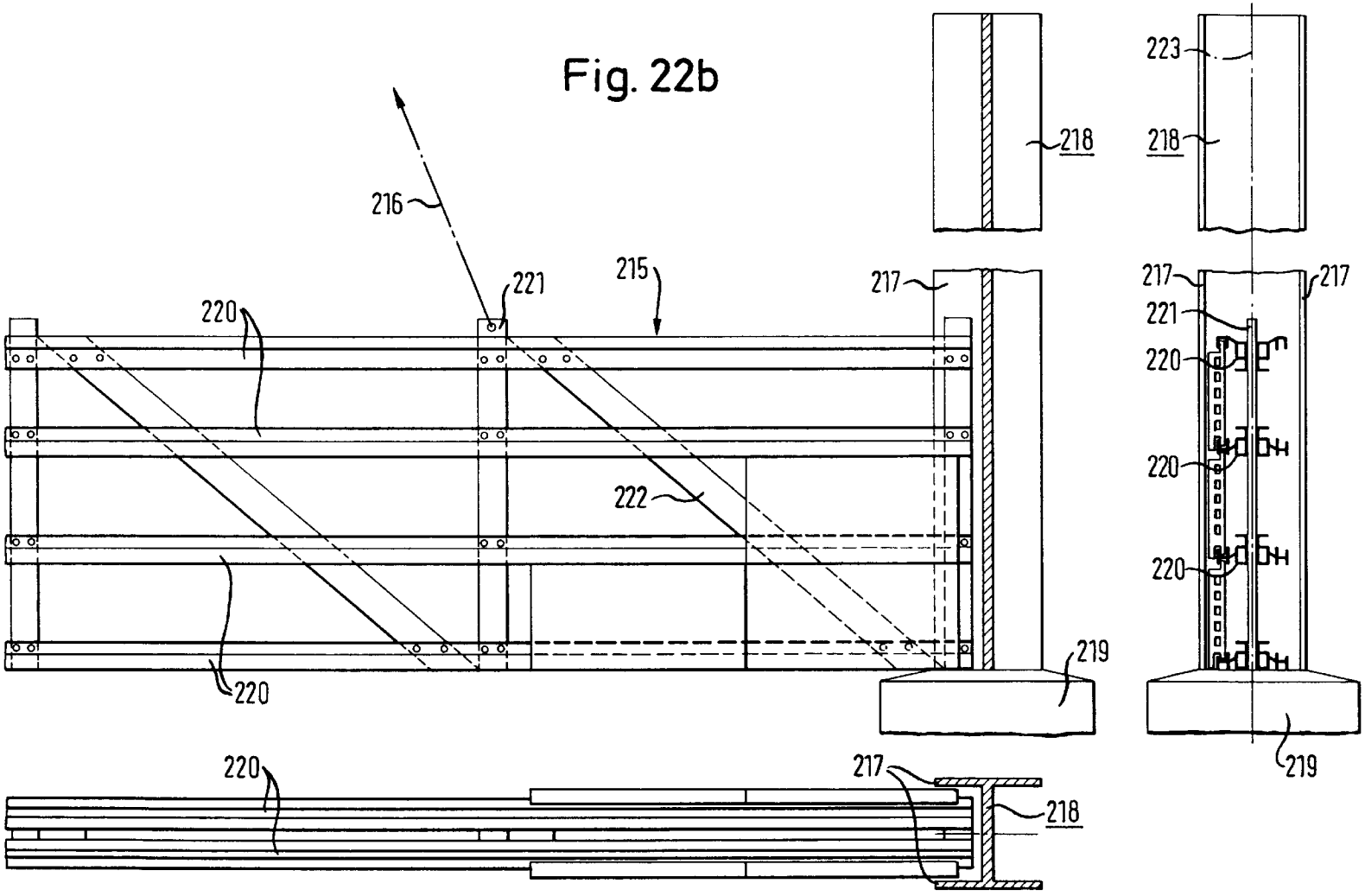

FIG. 22*b* shows an elevation, a vertical section and a horizontal section.

FIGS. 23–26 shows a vertical section and an elevation.

Figure 1:
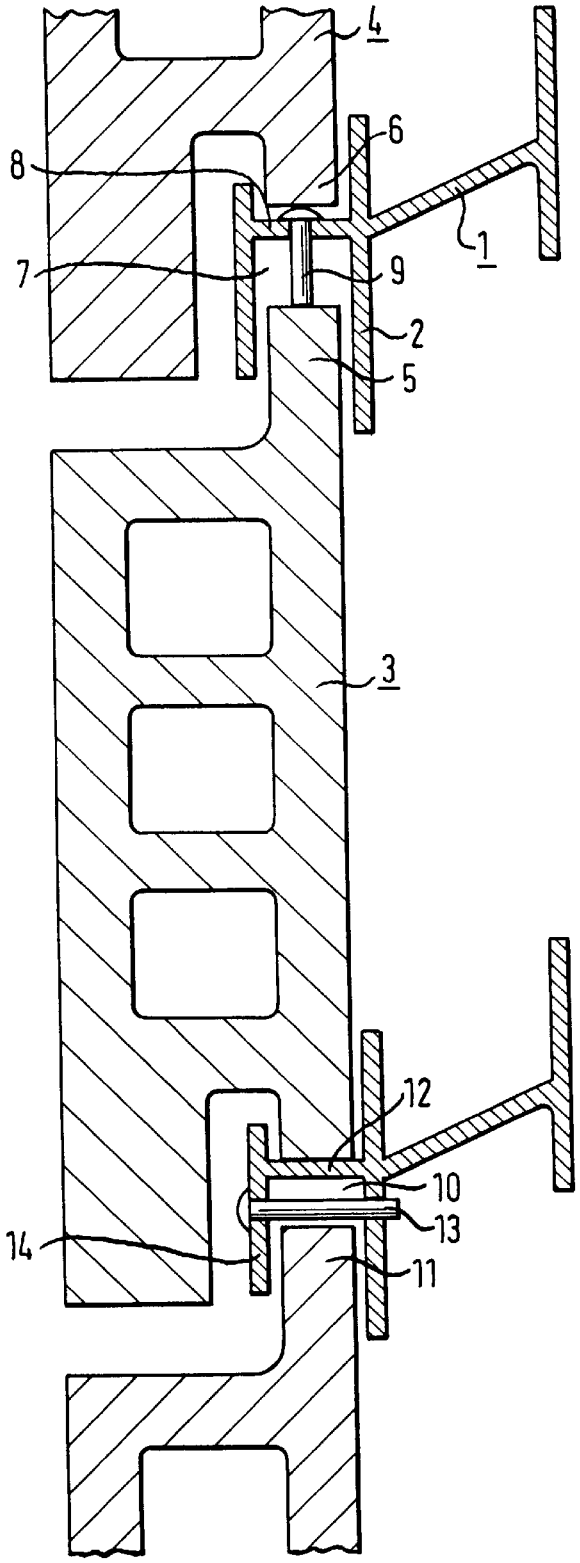
FIG. 1 shows a vertical section taken transversely through a facade structure in accordance with the invention.

In the upper part of FIG. 1 the reader will see that a support girder 1 is provided with an H section girder part 2, whose lower half fits about the top flange 5 of the facade tile 3 and whose top half is fitted about the bottom flange 6 of the facade tile 4. The vertical play 7 left between the top edge of the tile flange 5 and the center web 8 of the H section girder part 2 is completely or partly filled or spanned by a pin 9, which was inserted through an opening in the center web 8 and which is secured in place to prevent it dropping or being pulled out by the bottom flange 6 of the overlying facade tile 4. It will be seen from the bottom part of FIG. 1 that the vertical play 10 between the top flange 11 and the center web 12 is filled up or spanned by one or more horizontal pins 13, which are inserted through holes in the front bottom flange 14 directly over the top edge of the top flange 11 so that the lower facade tile is prevented from being lifted out of position.

Figure 2:
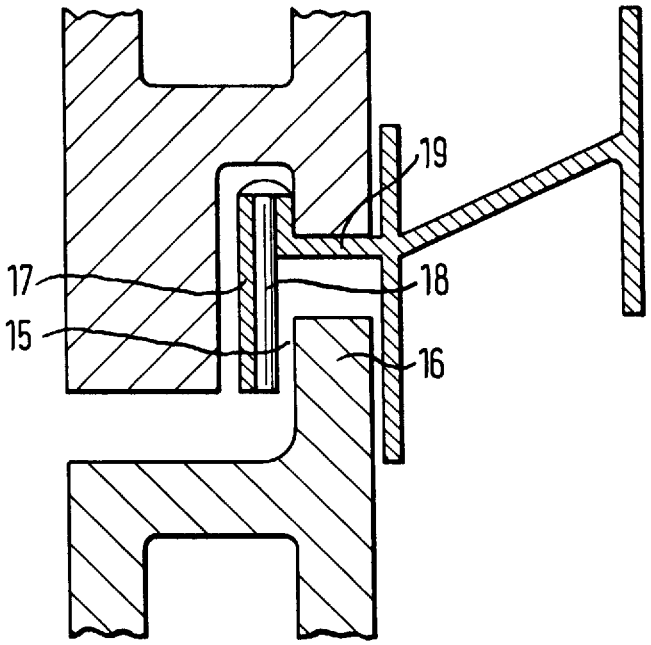
FIG. 2 shows a vertical section.

FIG. 2 indicates that the horizontal play 15 between the top flange 16 and the support girder 17 is completely or partly filled by a pin 18, which is inserted from above through an opening in the center web 19.

Figure 3:
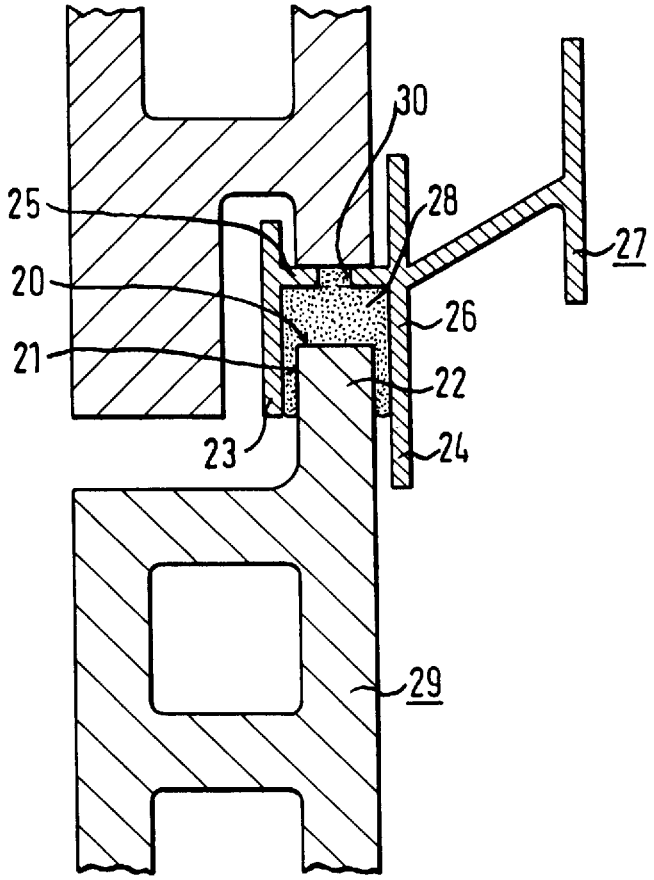
FIG. 3 shows a vertical section.

FIG. 3 indicates that the vertical play 20 and the horizontal play 21 between the top flange 22 of the facade tile 29 and the center web 25 and the vertical flanges 23 and 24 of the H section girder part 26 of the support girder 27 is filled by a filler composition 28. Same can be introduced before insertion of the facade tile 29 from below in the H section girder part. However it is simply possible to introduce it using, for example, collapsible tubes inserted through holes 30 in the center web 25 or through holes from the front in the front flange 23 with the result that adjacent to such holes cushions taking up play are obtained.

Figure 4:
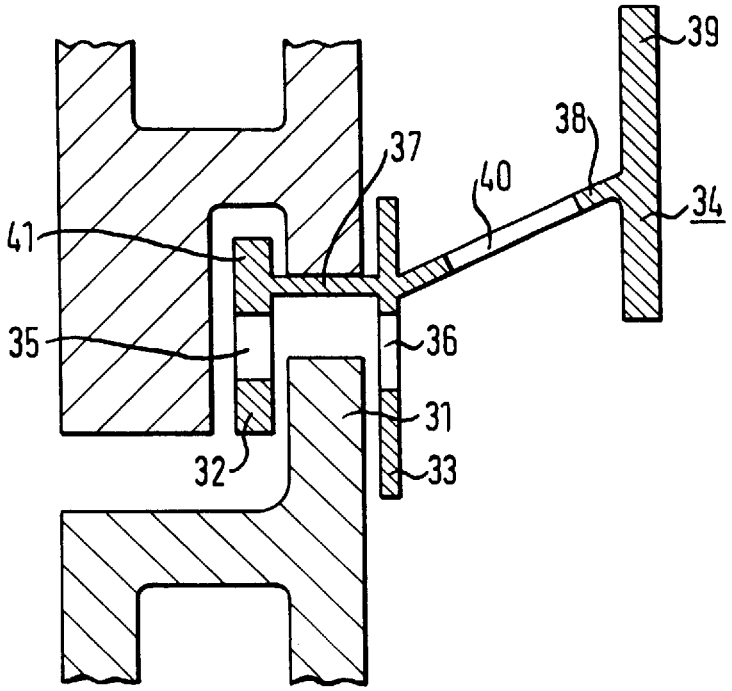
FIG. 4 shows a vertical section.

In FIG. 4 one support girder 34 is illustrated whose two lower or front flanges 32 and 33, which fit around the top flange 31, are provided with ventilation openings such as ventilation slots 35 and 36. Furthermore the front and rear flanges 32 and 33 of the H section girder part 37 are connected via the web 38 with the rear vertical flange 39 so that a horizontal double T girder is produced, which owing to its relatively high resistance moment may move around the vertical y axis owing to a strong wind force while having a low overall depth.

Using additional reinforcement means more particularly for the front flanges 32 and 41 and the rear flange 39 it is possible for the moment of resistance to be intentionally increased or the overall height can be reduced. The web 38, which rises to the rear, is provided with openings 40 so that water driven in by the wind or water condensate may escape forward toward the H section girder part 37 and thence to the rear side of the facade tiles.

In FIG. 5*a* a support girder 45 is illustrated, which in the horizontal web 42 of the H section girder part 43 is provided with partly stamped out lugs 44. These lugs are bent from above in a downward direction after fitting the facade tiles 46 in position until they come to rest against top edge or the top flange 47 of the facade tile 46 free of play or with only a little play, and prevent the facade tile 46 from being lifted.

In FIG. 5*b* a support girder 45 is depicted from whose horizontal web 42 a long lug 44 and a shorter one 48 are bent out so far downward that same contact the top edge of the top flange 47 of the facade tiles 46 with or without play.

In FIG. 5*c* the H section part of a support girder is represented, from whose horizontal web 49 lugs 50 through 56 with different outlines have been stamped, which have respectively one end thereof connected with the web 49 about which they may be bent. Such lugs are preferably arranged at such distances 57 apart that each facade tile may be secured in place by at least one bent lug. The obliquely cut lug 53 has its point penetrating somewhat into the surface of the facade tile or its top flange. The acute angled lug 54 has its point extending into the front gap between the top flange of the tiles and the front lower flange and compensates for horizontal play. Owing to its oblique arrangement the lug 55 exerts an additional horizontal force on the top flange and the lug 56 is arranged asymmetrically in the web 49.

In FIG. 6*a* it will be seen that lugs 60 are partly stamped out of the center web 66 of the H section girder parr of the support girder 49 and are so bent upward that an air gap 63 is obtained between the bottom edge of the bottom flange 61 of the upper facade tile 62 and the center web 66.

In FIG. 6*b* various different possible forms of the lugs 60, 64 and 65 will be perceived, which are partly so stamped out of the center web 66 and are bent out upward that between the bottom flange 61 and the center web 66 an air gap 63 is produced.

FIG. 7 shows that the center web 69 of the H section girder part 70 of the support girder 71 and the bottom edge of the bottom flange 76 of the facade tile 77 are designed sloping forward and downward. Accordingly the bottom flange 76 slides in the H section girder part 70 forward and lies free of play on the front top flange 78. The lug 79 in the oblique center web 69 serves to urge the top flange 80 of the facade tile 74 to the rear and lies without play, without any tendency to rattle, on the rear bottom flange 81. The thrust of the top flange 80 against rear bottom flange 81 can be also produced by bending suitable lugs 73 in the front bottom flange 72.

In FIG. 8 several flanges of the H section girder part 82 of the support girder 94 are provided at their ends 83, 84 and 85 with reinforcements directed toward the inner side of the H section. Consequently the transfer of wind and impact loads may be shifted from the top of the bottom flange 90 to the bottom thereof. Moreover, the top edge 87 of the front upper flange 86 is designed to slope obliquely downward in the forward direction and the rear bottom edge 88 of the bottom flange 90 of the facade tile 89 is designed rising obliquely to the rear in order to facilitate installation thereof. The rear flange 91, on the wall side, of the support girder 94 is located at generally the same level as the bottom flanges 92 and 93 of the H section girder part 82. The holes 95, 96 and 97 arranged in the three flanges 91, 92 and 93 are generally coaxial. Furthermore it is apparent that the inner side 98 of the top front flange 86 is made oblique. Furthermore the figure indicates that a web 99 is arranged generally at the bottom end of the flange 84, such web, which rises to the rear, producing the connection with the bottom end of the flange 91 on the building side. Together with the flanges 84 and 91 the web 99 constitutes a gutter for major amounts of water running for a short time down the back side of the facade. The water can drain away through the openings 100 again.

In FIG. 9 the part 101 on the wall side of the support girder 102 consists of a hollow box girder part 103 and an open part 104. Furthermore the figure indicates that in the oblique center web 105 of the H section girder part 106 securing lugs 107 are bent out downward, which abut against the oblique rear edge 108 of the top flange 109 of the facade tile 110 and thrust same both forward with an air gap against the spacer lugs 111 on the front bottom flange 112 and also thrust against the facade tile 110 to prevent same from being lifted upward. The top facade tile 113 has the oblique groove surface 114 of its bottom flange 115 resting on the spacer lugs 116, which are stamped out of the oblique center web 105 and are bent upward. The rear bottom flange 117 of the H section girder part 106 constitutes, together with the oblique web 118 and the front wall 119 of the hollow box girder 103, a water draining or catching gutter 120, from which water may flow through the openings 121 to the outside.

In FIG. 10 a horizontal flange 122 will be seen to be applied to the support girder 123 from which the downwardly and upwardly bent lugs 124 and 125 fit into the top grooves 126 and 127 of the facade tiles 128 and 129 and prevent same from being lifted or dropping out.

In FIG. 11 the bottom or top half 132 of the H section girder part 130 of the support girder 131 is offset in relation to the other half toward the building wall. Accordingly it is possible, despite having aligned front surface 133 and 134 of the top and bottom facade tiles 135 and 136, to design the bottom facade tile 135 with a greater overall depth and accordingly with an enhanced resistance to impact.

In FIG. 12 the holes 137 in the facade tile 138 are grouted or filled with concrete with the result that impact strength is approximately doubled. In the topmost and lowermost hole in addition a reinforcing rod 140 of stainless steel is additionally grouted in place, the rod not only enhancing impact strength but furthermore also preventing fracture of the tile perpendicularly to the holes.

FIG. 13 shows that horizontal support girders 141 are provided, which have an overall length of L1 and are attached approximately at the 1/5 point and, respectively, the 4/5 point, related to their overall length, to the rear main girders 142. The latter are for their part attached generally at the 1/5 point and, respectively, the 4/5 point of their overall length L2 by cleats to the building wall 144.

In accordance with FIG. 14 the support girders 148 are attached to the continuous main girders 145, which for their part, in the left hand part of the drawing, are attached to a wall angle cleat 146, bent into a meandering configuration and in the right hand part on a multiply bent, meandering wall angle cleat 147.

In FIG. 15 the support girders 160 are attached to the main girders 159, which for their part are attached to a singly bent meandering, angled sliding shoe 153 or a multiply bent sliding shoe 154. On thermal expansion of the main girders 159 perpendicularly to the plane of the drawing the limbs 155 and 156 of the sliding shoes 153 and 154 will slide along in the gap of the U-like, folded limb 157 and 158 of the fixed part 151 and 152 of the wall angle cleat 149 and 150.

In accordance with FIG. 16 the support girders 160 are grippingly encompassed by the edge flanges 162 and 163 of the bottom facade tiles 165 on either side. The lugs 166 of the support girder 160 may be bent by the bit of a key-like tool 168 in a downward direction. This tool has its one shank end 169 inserted in a rotary manner into the openings 170 of the vertical web 171 of the support girder 160, against which it will bear as soon as the lugs 166 are bent.

FIG. 17 shows a window sill tile 172, which is supported on two support girders 173 and 174, of which parts 175 and 176 have flanges 177 and 178 of the window sill tile 172 fitting underneath them. Lugs 179 are bent out from the support girder 174, which prevent horizontal displacement of the window sill tile 172.

In FIG. 18 a lintel tile 180 is illustrated in which is mounted on two support girder 181 and 182, of which parts 183 and 184 are overlapped by flanges 185 and 186 of the lintel tile 180. Lugs 187 are bent out of the support girder 182, which hold the lintel tile 180 to prevent horizontal displacement thereof. Screws 189 are driven into the support girder 188 to prevent horizontal displacement thereof.

In FIGS. 19*a* and 19*b* support girders 190 and 191 are shown, which on a plurality of sides are provided with obliquely set lugs 192 and 193 and are inserted into slots 194 and 195 in the facade tiles. In this respect the lugs are bent back elastically with the result that there is a play-free but nevertheless elastic attachment of the facade tile.

In FIGS. 20*a,* 20*b* and 20*c* moving shade elements 199 are represented in the case of which facade tiles 196 and 197 are threaded on a support girder 198. Trunnions 200 and 201 with screw threads of left and right hand are screwed into the end of the support girders, such trunnions being introduced into the terminal gaps between two facade tile, fit at each end in the holes in the tile the prevent same from being rotated in relation to one another.

In FIG. 21*a* a double side support girder is represented which on either side consists of H section parts 203 and 204, which are connected together by a web 205.

FIG. 21*b* shows another double sided support girder, in which the H section parts 203 and 204 on each side are joined by oblique webs 206 and 207 to a center hollow box girder 208.

In FIG. 22*a* a vertical section taken through an acoustic screen will be seen. In this case two symmetrically arranged support girders 209 are so joined together by means of a vertical and diagonal flat girders 211, which are arranged in the plane 210 of symmetry, that in combination with pairs of support girders arranged thereover and/or thereunder a trussed girder is obtained. The externally placed flanges 212 of the H section girder part 213 are reinforced in order to enhance the resistance moment Wy about the y axis 214.

In FIG. 22*b* the reader will see one half of the trussed girder 215. It is lowered into position by means of a crane and ropes 216 from above between the flanges 217 of the supports 218 on each side and put down on the foundations 219 on each side. The trussed girder 215 itself comprises the pairs of superposed horizontal support girders 220, the vertical flat girders 221 and the diagonal members 222, which are arranged in the plane 223 of symmetry.

Figure 23:
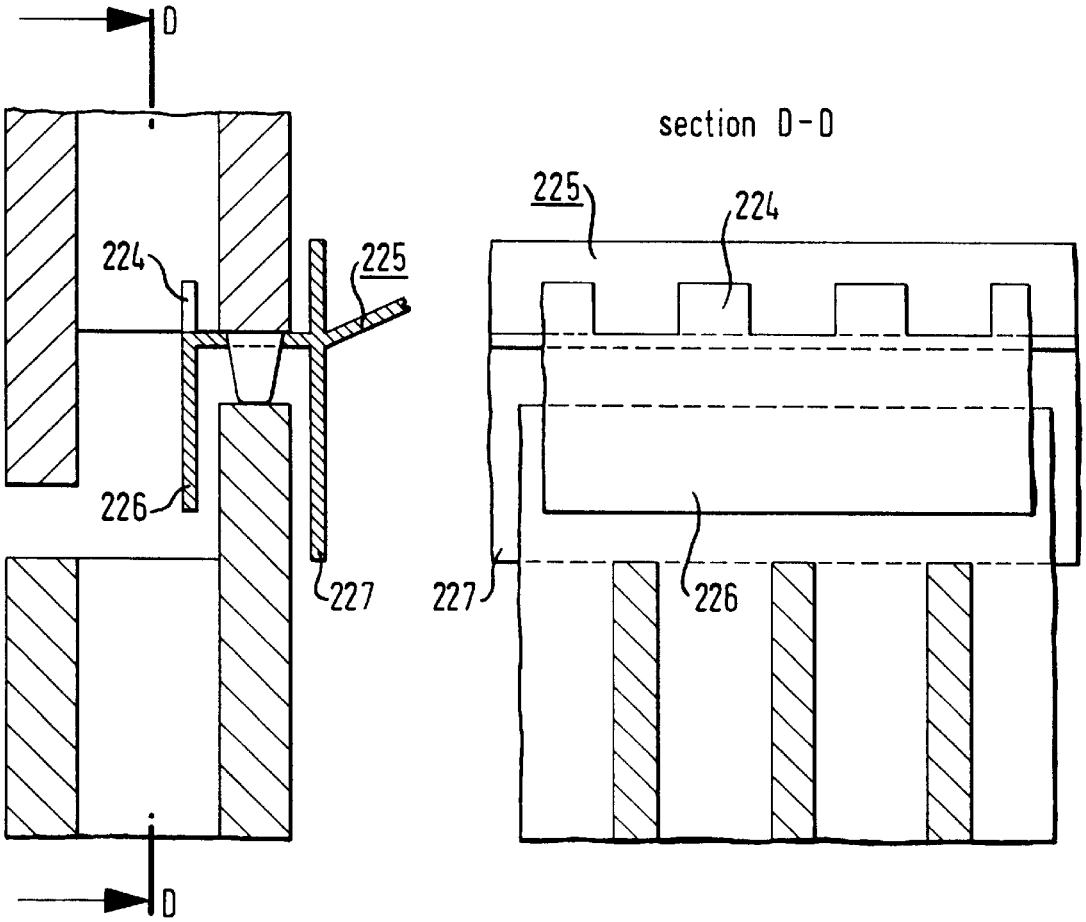

In FIG. 23 a support girder 277 is depicted: the front limb 224 of the H section support girder 225 is toothed and the other front limb 226 is made continuous.

Figure 24:
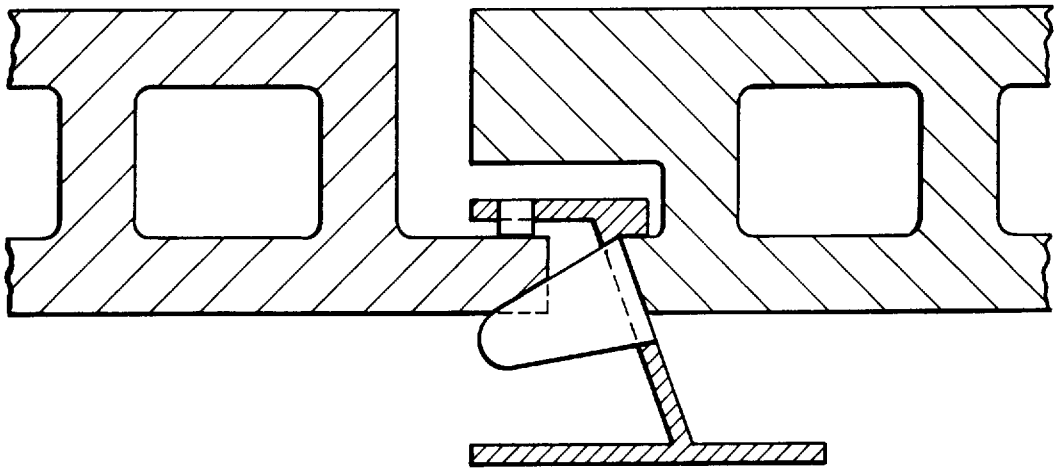
Figure 25:
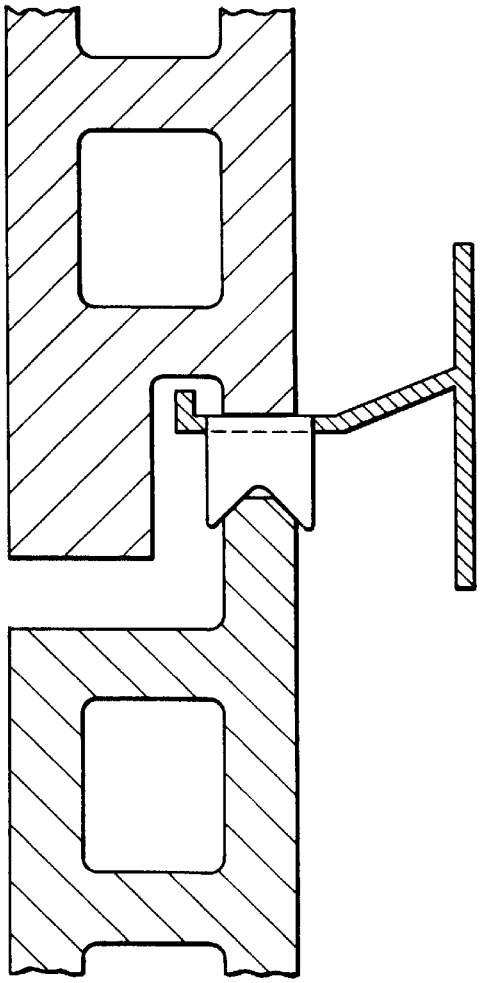
Figure 26:
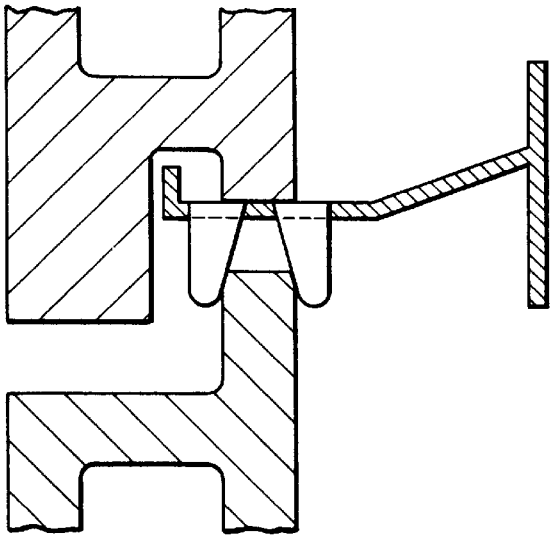

In FIGS. 24, 25 and 26 embodiments of the invention are depicted from which it will be apparent that the girder part, which fits around parts of the facade tiles, more particularly tile flanges, must not have an H or U section.

In FIG. 24 an embodiment is shown which is similar to that of FIG. 9. Unlike the design of FIG. 9 in the design of FIG. 24 the rear bottom flange 117 and the oblique web 118 are not present. In FIG. 24 the oblique center web 105 is directly joined to the wall girder. The oblique center web 105 in the design of FIG. 24 could also be joined with the front wall of a hollow box girder (in FIG. 24 not illustrated). The facade tile located over the girder part has its bottom flange placed on the oblique center web 105. In the design of FIG. 24 as well it is possible for the spacer lugs 116 to be employed, which are illustrated in FIG. 9, but they are not illustrated in FIG. 24. The top flange of the facade tile located underneath the girder in the embodiment of FIG. 24 is held in a manner similar to that of FIG. 9 held by the spacer lugs 111 of the front bottom flange 112 and the securing lugs 107 of the oblique center web 105.

In the case of the working embodiment of FIG. 26 not only the rear top end of the top flange of the facade tile located underneath the girder part is held by an anchoring lug but also the front top end thereof. The top flange is hence held both at the rear side and also at the front side by a respective anchoring lug. Both anchoring lugs are joined with the horizontal web of the girder part.

FIG. 25 shows a modification of the design of FIG. 26. In the embodiment of FIG. 25 only one single anchoring lug is present, which is joined to the horizontal web of the girder part and possesses two obliquely extending edges, of which the one abuts the rear top edge of the top flange and the other abuts against the front top edge of the top flange. The anchoring lug of FIG. 25 accordingly unites the functions of the two anchoring lugs of FIG. 26 in a single component.

We claim:

1. A bracket mounted facade structure, comprising:

a plurality of facade tiles, a plurality of support girders, each of the plurality of support girders comprising a web and a girder part to grippingly engage parts of the plurality of facade tiles, a first play established between one of the plurality of facade tiles and the web in one of the plurality of support girders, the girder part of the one of the plurality of support girders being at least partially spanned by means of first pins inserted into the first play, a second play established between another one of the plurality of facade tiles and the web in another one of the plurality of support girders, the second play being at least partially spanned by a second pin fitted in the second play, and the second pin being generally transverse to the first pins.

2. The bracket mounted facade structure claimed in claim 1, wherein:

each of the plurality of facade tiles have opposing flanges engaging the plurality of support girders.

3. A bracket mounted facade structure, comprising:

a plurality of facade tiles, a support girder comprising a girder part, which is formed as an H section, having a web to support parts of the plurality of facade tiles, the web engaging and supporting the parts of the plurality of facade tiles from within and to one side of the plurality of facade tiles, a plurality of protruding lugs protruding from the web, the protruding lugs forming an acute angle with the web, the protruding lugs bearing against at least one of the plurality of facade tiles, the protruding lugs are short lugs and long lugs, and at least some of the protruding lugs selectively extend in the same and in opposite directions.

4. A bracket mounted facade structure, comprising:

a plurality of facade tiles, a support girder comprising a girder part, which is formed as an H section, having a web to support parts of the plurality of facade tiles, and a pair of generally parallel H section flanges, the web engaging and supporting the plurality of facade tiles from within and to one side of the plurality of facade tiles, a plurality of protruding lugs protruding from the web, the protruding lugs forming an acute angle with the web, the protruding lugs bearing against at least one of the plurality of facade tiles, the support girder comprising another flange, the web extends obliquely relative to the pair of generally parallel H section flanges, and forms an acute angle with the pair of generally parallel H section flanges and with the another flange, one of the pair of generally parallel H section flanges has lugs that protrude toward the web, wherein the lugs protrude toward the web on the side thereof that forms an obtuse angle with the pair of generally parallel H section flanges.

* * * * *